US006004419A

United States Patent [19]

Torii

[11] Patent Number: 6,004,419

[45] Date of Patent: Dec. 21, 1999

[54] HEAT TRANSFER PRINTING PROCESS FOR PRODUCING RAISED IMAGES

[75] Inventor: Masanori Torii, Tokyo-To, Japan

[73] Assignee: Dai Nippon Printing Co., Ltd., Japan

[21] Appl. No.: 08/877,900

[22] Filed: Jun. 18, 1997

Related U.S. Application Data

[62] Division of application No. 08/578,927, Dec. 27, 1995, Pat. No. 5,677,049.

[30] Foreign Application Priority Data

| | | | |
|---|---|---|---|
| Dec. 27, 1994 | [JP] | Japan | 6-337786 |
| Dec. 27, 1994 | [JP] | Japan | 6-337787 |
| Jan. 18, 1995 | [JP] | Japan | 7-22376 |
| Aug. 10, 1995 | [JP] | Japan | 7-225886 |
| Aug. 10, 1995 | [JP] | Japan | 7-225887 |
| Aug. 10, 1995 | [JP] | Japan | 7-225888 |

[51] Int. Cl.[6] ..... B41M 7/00; B44C 1/16

[52] U.S. Cl. ..... 156/234; 156/235; 156/277; 427/373; 430/401

[58] Field of Search ..... 156/235, 277, 156/234; 427/373; 428/195, 304.4, 484, 488.1, 488.4, 913, 914; 430/200, 401

[56] References Cited

U.S. PATENT DOCUMENTS

| | | | |
|---|---|---|---|
| 4,500,373 | 2/1985 | Kubota | 156/79 |
| 4,564,534 | 1/1986 | Kushida et al. | 427/256 |

FOREIGN PATENT DOCUMENTS

| | | | |
|---|---|---|---|
| 63-299978 | 12/1988 | Japan | 428/195 |

*Primary Examiner*—Bruce H. Hess
*Attorney, Agent, or Firm*—Parkhurst & Wendel, L.L.P.

[57] ABSTRACT

The present invention provides a heat transfer printing sheet comprising a substrate sheet, and a thermally-expandable ink layer formed thereon, comprising as an expanding agent a thermally-expandable micro-capsule containing therein an easily-volatilizable hydrocarbon, and a binder resin having a number-average molecular weight of 1,000 to 30,000.

The present invention also provides a heat transfer printing sheet comprising a substrate sheet, a release-property-controlling layer and a thermally-expandable ink layer comprising an expanding agent and a binder, in the mentioned order.

The present invention further provides a process for producing raised images, comprising the steps of superposing, on an image-receiving sheet, a heat transfer printing sheet comprising a substrate sheet and a thermally-expandable ink layer formed thereon, heating image-wise the thermally-expandable ink layer and bringing the heat transfer printing sheet into pressure contact with the image-receiving sheet, releasing the heat transfer printing sheet from the image-receiving sheet, thereby separating image-wise the thermally-expandable ink layer from the heat transfer printing sheet and transferring it to the image-receiving sheet, applying light to the thermally-expandable ink layer which has been transferred image-wise to the image-receiving sheet to expand it, thereby obtaining raised images.

3 Claims, 5 Drawing Sheets

HEAT TRANSFER PRINTING PROCESS FOR PRODUCING RAISED IMAGES

This is a Division of application Ser. No. 08/578,927 filed Dec. 27, 1995, now U.S. Pat. No. 5,677,049.

BACKGROUND OF THE INVENTION

1. Field of the Invention

The present invention relates to a heat transfer printing sheet useful for producing raised images, in particular, raised letters for the blind. More particularly, the present invention relates to a heat transfer printing sheet for producing raised images, having excellent image-transferability, capable of producing raised images which are highly readable with the fingers and highly resistant to touch reading, and to an improved process for producing raised images.

2. Background Art

To print raised letters for the blind in accordance with out-put informations from a computer, there has been conventionally adopted such a method in that raised dots readable with the fingers are formed on paper by means of embossing, for instance, by using a raised-letter printer "TP-32" manufactured by Toyo Hybrid Co., Ltd.

In order to print raised letters on paper by the above method, it is necessary to use paper which has a thickness large enough not to be broken when raised dots are formed thereon by means of embossing. Therefore, it has been impossible to print readable raised letters on thin paper having a thickness of less than 100 micrometers, such as copying paper.

Further, when raised letters are produced by embossing, concave depressions are formed on the surface of paper, opposite to the surface which is touched with the fingers to read the raised letters. For this reason, there has been a problem in that when raised letters are formed on the back surface of paper on which letters are ordinarily printed in an ink for the seeing, it becomes laborious for the seeing to read the inked letters due to the concave depressions of the raised letters formed on the other surface of the paper. (Hereinafter, those who have normal eyesight are referred t as the seeing in contrast to the blind, and those letters which are printed for the seeing are referred to as inked letters in contrast to raised letters for the blind.)

Japanese Laid-Open Patent Publication No. 333858/1992 discloses, as a means for solving these problems, a technique of producing raised letters by melt transfer of an ink film conducted by using a heating means.

However, in order to obtain readability comparable to that of conventional raised letters produced by means of embossing, the raised letters produced by the above technique are required to have a height of 300 micrometers or more which is equal to the height of embossed raised letters. In order to transfer such a thick layer from a heat transfer printing sheet by using a thermal head, it is necessary to apply an extremely large amount of energy to the substrate film side of the heat transfer printing sheet. For this reason, there has been a problem in that the substrate film tends to be broken due to such a large amount of energy applied.

In addition, it has been very difficult to apply such a large amount of energy to a thermal head for reasons of the performance thereof.

On the other hand, Japanese Laid-Open Patent Publication No. 238984/1989 or the like discloses a technique in which heat is applied to a heat transfer printing sheet comprising a substrate sheet and a thermally-expandable ink layer formed thereon, containing an expanding agent, to transfer image-wise the thermally-expandable ink layer to an image-receiving sheet, and heat is further applied to the thermally-expandable ink layer on the image-receiving sheet so as to expand it to obtain a three-dimensional raised image. According to this publication, the thermally-expandable ink layer comprises a wax such as carnauba wax, and a thermally-decomposable expanding agent such as sodium bicarbonate or azobisisobutyronitrile.

However, those raised letters for the blind which are produced by using the heat transfer printing sheet of the above-described prior technique have the problem of resistance to touch reading; for example, due to the friction caused by the fingers, the raised letters are broken, the height thereof is readily decreased (the raised letters are worn out), or a part of or all of the dot elements of the raised letters fall off the image-receiving sheet. In addition, since the touch of these raised letters is largely different from that of ordinary raised letters formed on thick paper by means of embossing, the raised letters produced by this technique are poor in readability.

Furthermore, in the case where raised letters are produced by the use of the above-described heat transfer printing sheet, such a trouble tends to be caused that predetermined images cannot be precisely obtained, that is, the part of the thermally-expandable ink layer to which thermal energy has been applied is not fully transferred to an image-receiving sheet, or even the part of the ink layer to which thermal energy has not been applied is transferred to an image-receiving sheet, because the adhesion between the substrate sheet and the thermally-expandable ink layer is not proper.

When any excess or deficiency is present in the transferred dot elements of the raised letters for the blind, a serious problem will be brought about because such raised letters are misread even if the excess or deficiency is slight and not a problem for the seeing at all.

According to the above-mentioned Japanese Laid-Open Patent Publication No. 238984/1989, the expansion of the thermally-expandable ink layer which has been transferred image-wise to the image-receiving sheet is conducted by heating the non-printing surface of the image-receiving sheet for one minute by using a heating roller whose surface temperature is 150° C.

However, in this method, the thermal expansion gradually proceeds from the interface between the thermally-expandable ink layer transferred and the image-receiving sheet towards the surface of the ink Layer. For this reason, when it is tried to expand the thermally-expandable ink layer entirely, the temperature of the binder resin contained in the ink layer reaches the softening point thereof, and coagulation is caused. As a result, such a trouble tends to be caused that the thickness of the thermally-expandable ink layer is decreased or that the adhesion of the expanded image to the image-receiving sheet is drastically decreased.

On the other hand, to print inked letters beside raised letters so as to show how to read the raised letters is considered to be extremely valuable because written informations can be simultaneously provided to both the seeing and the blind.

However, in the case where a conventional raised-letter printer employing the embossing technique is used, it is practically impossible to obtain inked letters by using a printing head useful for the formation of raised letters. Therefore, besides the printing head for producing raised letters, it is necessary to use another printing head for printing inked letters. When these two different types of printing heads are used to produce the two types of images, the process for printing the images becomes extremely complicated. Much labor and a long time have thus been needed to produce a sheet of print on which these images are printed.

Japanese Laid-Open Patent Publication No. 167156/1981 discloses, as a means for solving the aforementioned problems, a technique of simultaneously producing raised letters and inked letters by an electrophotographic process in which both an expandable toner and an ordinary toner are used.

However, in the case where a document containing both raised letters based on the method of writing Japanese raised letters, and inked letters showing how to read the raised letters is prepared by the combination use of an expandable toner and an ordinary toner in accordance with the invention disclosed in the above publication, although the inked letters can be read without difficulty, the raised letters have the problem of resistance to touch reading; for instance, due to the friction caused by the fingers, the raised letters are broken, the height thereof is readily decreased (the raised letters are worn out), or a part of or all of the dot elements of the raised letters fall off the image-receiving sheet.

In addition, the touch of the raised letters produced by this method is greatly different from that of ordinary raised letters produced on thick paper by means of embossing. Therefore, there has been a problem in that the raised letters obtained by this method is poor in readability.

The present invention is directed to overcome or at least to mitigate the aforementioned drawbacks in the prior art.

An object of the present invention is therefore to provide a heat transfer printing sheet capable of producing highly raised images which are excellent in readablity with the fingers and in resistance to touch reading.

Another object of the present invention is to provide a heat transfer printing sheet having improved image-transferability.

A further object of the present invention is to provide a heat transfer printing sheet capable of simultaneously producing inked letters, and highly raised letters which are excellent in resistance to touch reading.

A still further object of the present invention is to provide an improved process for producing raised images, for use in a heat transfer printing system, capable of producing, without damaging an image-receiving sheet, raised images which are improved in height and resistance to touch reading.

Other objects and the effects of the present invention will become apparent to those skilled in the art in the course of the following description.

SUMMARY OF THE INVENTION

The above objects of the present invention can be attained by a heat transfer printing sheet for producing raised images, comprising a substrate sheet, and a thermally-expandable ink layer formed thereon, comprising as an expanding agent a thermally-expandable micro-capsule containing therein an easily-volatilizable hydrocarbon, and a binder resin having a number-average molecular weight of 1,000 to 30,000.

According to a preferred embodiment of the present invention, the above heat transfer printing sheet further comprises a release-property-controlling layer between the thermally-expandable ink layer and the substrate sheet.

According to another preferred embodiment of the present invention, the thermally-expandable ink layer of the heat transfer printing sheet has cracks on the surface thereof.

According to another preferred embodiment of the present invention, the heat transfer printing sheet further comprises a hot-melt coloring layer comprising a coloring material and a hot-melt binder on top of or in sequence to the thermally-expandable ink layer.

The present invention also provides a heat transfer printing sheet for producing raised images, comprising a substrate sheet, a release-property-controlling layer formed on the substrate sheet, and a thermally-expandable ink layer formed on the release-property-controlling layer, comprising an expanding agent and a binder.

Further, the present invention provides a process for producing raised images, comprising the steps of superposing, on an image-receiving sheet, a heat transfer printing sheet comprising a substrate sheet and a thermally-expandable ink layer formed thereon, heating image-wise the thermally-expandable ink layer and bringing the heat transfer printing sheet into pressure contact with the image-receiving sheet, releasing the heat transfer printing sheet from the image-receiving sheet, thereby separating image-wise the thermally-expandable ink layer from the heat transfer printing sheet and transferring it to the image-receiving sheet, and applying light to the thermally-expandable ink layer which has been transferred image-wise to the image-receiving sheet to expand it, thereby obtaining raised images.

The heat transfer printing sheet of the present invention comprises, as the binder resin of the thermally-expandable ink layer, a resin having a specific molecular weight. Therefore, the raised images obtained by using the heat transfer printing sheet are stable and excellent in resistance to touch reading. Further, since a specific thermally-expandable micro-capsule is used as the expanding agent, the raised images obtained are highly raised, have high elasticity, are not readily broken by touch reading, and can be fully restored even if deformed.

When a release-property-controlling layer is further provided in the heat transfer printing sheet, the release property (image-transferability) of the thermally-expandable ink layer from the substrate sheet is improved, so that images can be produced more accurately.

The formation of cracks on the surface of the thermally-expandable ink layer also contributes to an improvement in the image-transferability.

Further, when the heat transfer printing sheet comprising a hot-melt coloring layer formed on top of or in sequence to the thermally-expandable ink layer is used, it is made possible to produce raised images and inked images at the same time by using a single printing means (for example, a thermal head).

By the process for producing raised images according to the present invention, in which the thermal expansion of the thermally-expandable ink layer which has been transferred image-wise to an image-receiving sheet is conducted not by the use of a hot plate as in the above-described conventional techniques but by the application of light, highly raised images can be obtained without damaging the image-receiving sheet.

DETAILED DESCRIPTION OF THE INVENTION

Referring now to the accompanying drawings, the preferred embodiments of the present invention will be explained in detail.

Figure 1:
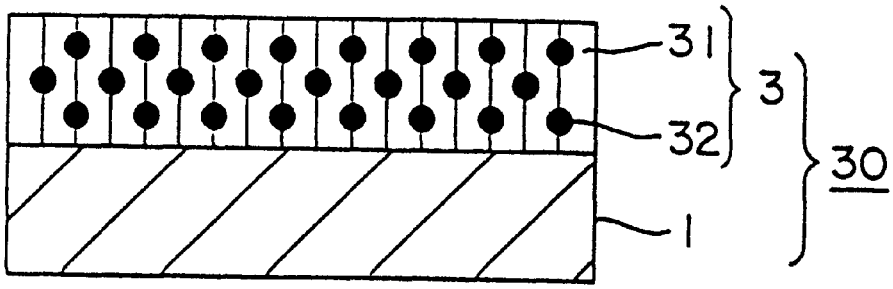
FIG. 1 is a diagrammatic sectional view of a heat transfer printing sheet according to the present invention.

As shown in FIG. 1, a heat transfer printing sheet 30 comprises a substrate sheet 1, and a thermally-expandable ink layer 3 provided on one surface thereof. The ink layer 3 comprises a binder resin 31, and a thermally-expandable micro-capsule 32 containing therein an easily-volatilizable hydrocarbon.

There is no particular limitation on the material for the substrate sheet 1, and any substrate sheet used for the conventional heat transfer printing sheets can be used as the substrate sheet 1 as long as it can endure heat which is applied when heat transfer printing is conducted. Preferable examples of the substrate sheet include stretched or non-stretched films of polyester, polypropylene, cellophane, polycarbonate, cellulose acetate, polyethylene, polystyrene, nylon, polyimide, polyvinylidene chloride, polyvinyl alcohol, a saponified product of an ethylene-vinyl acetate copolymer, fluororesin, chlorinated rubber and ionomer, and papers such as condenser paper and paraffin paper.

The thickness of the substrate sheet 1 can be properly selected depending upon the material used so that the strength and the thermal conductivity thereof can be properly controlled. However, the thickness of the substrate sheet 1 is preferably from 2 to 100 micrometers, more preferably from 3 to 25 micrometers.

In the present invention, the thermally-expandable ink layer 3 comprises a binder resin 31, and a thermally-expandable micro-capsule 32 containing therein an easily-volatilizable hydrocarbon.

The thermally-expandable micro-capsule 32 takes such a structure that a hydrocarbon volatilizable at low temperatures is enclosed with a wall made of a thermoplastic resin. In the present invention, the micro-capsule 32 is such that the volume thereof is expanded 10 to 150 times the original volume when heated by the application of light or the like.

Examples of the hydrocarbon to be included in the thermally-expandable micro-capsule 32 include methyl chloride, methyl bromide, trichloroethane, dichloroethane, n-butane, n-heptane, n-propane, n-hexane, n-pentane, isobutane, isoheptane, neopentane, petroleum ether, an aliphatic hydrocarbon containing fluorine such as Freon, and a mixture thereof.

Examples of the material for the wall of the thermally-expandable micro-capsule 32 include polymers of vinylidene chloride, vinyl chloride, acrylonitrile, styrene, polycarbonate, methyl methacrylate, ethyl methacrylate and vinyl acetate, copolymers of these monomers, and mixtures of the polymers or the copolymers. A crosslinking agent may be used, when necessary.

The diameter of the thermally-expandable micro-capsule 32 is preferably from 0.1 to 50 micrometers, more preferably from 0.1 to 30 micrometers.

Examples of a commercially available micro-capsule which can be used as the thermally-expandable micro-capsule 32 include F-20, F-30, F-40, F-50, F-80S, F-82, F-80VS and F-100 of the "MATSUMOTO MICRO SPHERE" series manufactured by Matsumoto Yushi-Seiyaku Company, Ltd., and the micro-capsules of the "Expancel" series manufactured by Nippon Ferrite Co., Ltd.

Examples of the material for the binder resin 31 to be used for the thermally-expandable ink layer 3 include vinyl resins such as polyvinyl acetate, polyacrylate and polymethacrylate, polyester resins such as polyethylene terephthalate and polybutylene terephthalate, polystyrene, polyamide, polyurethane, polyacrylonitrile, vinyl chloride-vinylidene chloride copolymers, acrylonitrile-vinylidene chloride copolymers, and rubber resins such as vulcanized rubbers and unvulcanized rubbers. Examples of the rubber resins include vulcanized or unvulcanized natural rubbers and synthetic rubbers such as chloroprene rubber, fluororubber, silicone rubber, synthetic isoprene rubber, butyl rubber, urethane rubber, acrylic rubber, styrene-butadiene rubber, ethylene-propylene rubber, polyisoprene rubber, butadiene rubber, nitrile rubber and chlorinated butyl rubber. Of these, polyester resins are particularly preferred.

It is preferable that the number-average molecular weight of the resin used as the binder resin 31 be 1,000 or more.

When a natural wax having a number-average molecular weight of less than 1,000, such as carnauba wax, paraffin wax or beeswax, or a synthetic wax having a number-average molecular weight of less than 1,000, such as polyethylene wax, stearic acid or flax wax is used as a main component of the binder resin, the resulting raised images may be extremely brittle.

Further, the viscosity of such a low-molecular-weight binder tends to be drastically lowered when the binder is softened or melted at the time when the thermally-expandable ink layer which has been transferred image-wise to an image-receiving sheet from the heat transfer printing sheet is expanded to obtain raised images. For this reason, there may be a case where the softened or melted binder infiltrates into the image-receiving sheet or runs around the raised images produced on the image-receiving sheet. Thus, the thermally-expandable micro-capsule cannot be fully retained on the image-receiving sheet.

In the case where minute raised images such as raised letters are obtained on an image-receiving sheet by heat transfer printing, it is very important for obtaining accurate images that only those parts of an ink layer which have been heated be exactly transferred to an image-receiving sheet. It is therefore necessary that the binder resin phase in the thermally-expandable ink layer 3 be separated when heat transfer printing is conducted so that only the desired part of the ink layer can be successfully transferred to an image-receiving sheet. In order to attain this, the number-average molecular weight of the binder resin is preferably 30,000 or less, particularly 25,000 or less.

Namely, when both the accuracy in the formation of raised images such as raised letters and the resistance to touch reading are taken into consideration, the number-average molecular weight of the binder resin is preferably 1,000 or more and 30,000 or less, more preferably 3,000 or more and 25,000 or less, and most preferably 10,000 or more and 25,000 or less.

A coloring agent can be incorporated into the thermally-expandable ink layer 3, when necessary.

The amount of the coloring agent to be incorporated can be freely selected within such a range that the formation of the thermally-expandable ink layer 3 on the substrate sheet 1 is not adversely affected by the coloring agent. Namely, it is preferable to select the coloring agent from those which can be uniformly dissolved or dispersed in a solvent or a dispersion medium which is used in a coating liquid for forming the thermally-expandable ink layer 3.

For instance, in the case where the thermally-expandable ink layer 3 is formed by coating an aqueous dispersion whose dispersion medium is water, it is preferable to select the coloring agent from those which can be uniformly dispersed or dissolved in water. In order to color the thermally-expandable ink layer with gray or black, an aqueous dispersion of carbon black may be used; in order to color the thermally-expandable ink layer with a chromatic color, a water-soluble or dispersible organic or inorganic pigment of the desired color may be used.

Similarly, when the thermally-expandable ink layer 3 is formed by using a solution of a coloring agent in a mixture of water and an organic solvent or in an organic solvent, it is preferable to select the coloring agent from those which can be uniformly dispersed or dissolved in the solvent or the dispersion medium. It is, of course, possible to color the thermally-expandable ink layer with the desired color depending upon the desired hue, chroma and color value.

Further, any of the following coloring agents can also be used: a coloring agent which is colorless at the time when the thermally-expandable ink layer 3 containing the agent is formed on the substrate sheet, but develops a color when thermal energy is applied to the ink layer to conduct heat transfer printing, or when light energy is applied, as will be described later, to expand the ink layer which has been transferred to an image-receiving sheet; a coloring agent which develops a color when it is brought into contact with a substance which has been coated onto the surface of an image-receiving sheet; and a coloring agent which develops a color or whose original color is changed to any other color when raised images produced by the thermal expansion of the ink layer are touched with the fingers.

Furthermore, a heat-conductive substance can also be incorporated into the thermally-expandable ink layer 3 in order to impart thereto good thermal conductivity and melt transferability. A powder, a finely divided powder or a whisker of a metal such as copper or aluminum, a metal oxide such as tin oxide, or a metal sulfide such as molybdenum disulfide, or a carbonic substance such as carbon black can be used as the heat-conductive substance.

The thermally-expandable ink layer 3 is formed in the following manner: a solution or a dispersion which is prepared by dissolving or dispersing the above-described resin together with, when necessary, a crosslinking agent and a crosslinking-reaction-accelerating catalyst in a proper organic solvent, or in a mixture of an organic solvent and water, or in water is coated onto one surface of the above-described substrate sheet 1 by a conventional means such as gravure coating, coating using a screen, reverse-roll coating using a gravure, or air-knife coating, and the resulting layer is then dried to obtain the ink layer.

The thickness of the thermally-expandable ink layer 3 is preferably from 10 to 100 micrometers, more preferably from 20 to 80 micrometers.

The amount of the thermally-expandable micro-capsule 32 incorporated into the thermally-expandable ink layer 3 is preferably from 30 to 200 parts by weight, particularly from 50 to 150 parts by weight for 100 parts by weight of the binder resin. When the amount of the thermally-expandable micro-capsule 32 is less than 30 parts by weight, the thermally-expandable ink layer 3 cannot be fully expanded. On the other hand, when the amount of the micro-capsule 32 is in excess of 200 parts by weight, the resulting raised images tend to have insufficient resistance to touch reading.

In the above-described embodiment of the present invention, the thermally-expandable micro-capsule 32 is incorporated into the thermally-expandable ink layer 3 so that the ink layer 3 can be expanded. However, any of the following expanding agents can also be used instead of the thermally-expandable micro-capsule. In this case, however, the resistance to touch reading of the resulting raised images is inferior to that of the raised images obtained by using the heat transfer printing sheet comprising the thermally-expandable micro-capsule. The reason for this may be such that the thermally-expandable micro-capsule can impart high elasticity to the raised images produced.

Examples of the expanding agent which can be used in the present invention include organic expanding agents such as azodicarbonamide, azobisisobutyronitrile, dinitrosopentamethylenetetramine, N,N'-dinitroso-N,N'-dimethylterephthalamide, p-toluenesulfonyl hydrazide, hydrazolcarbonamide, p-toluenesulfonyl azide and acetone-p-sulfonyl hydrazone; and inorganic expanding agents such as sodium bicarbonate, ammonium carbonate and ammonium bicarbonate.

Figure 4A:
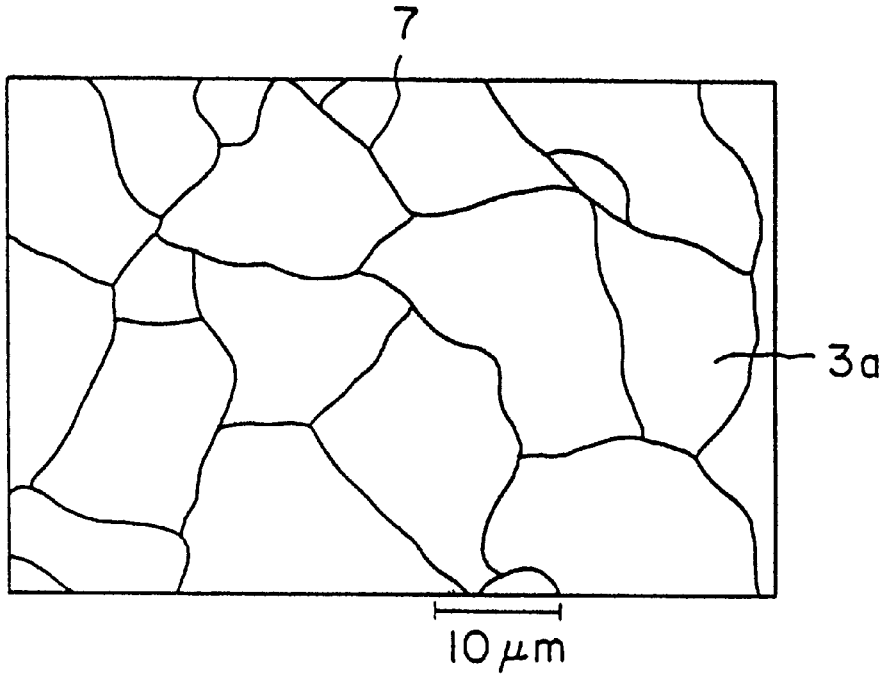
FIGS. 4A and 4B are illustrations showing the cracks formed on the surface of the thermally-expandable ink layer of a heat transfer printing sheet of the present invention.
Figure 4B:
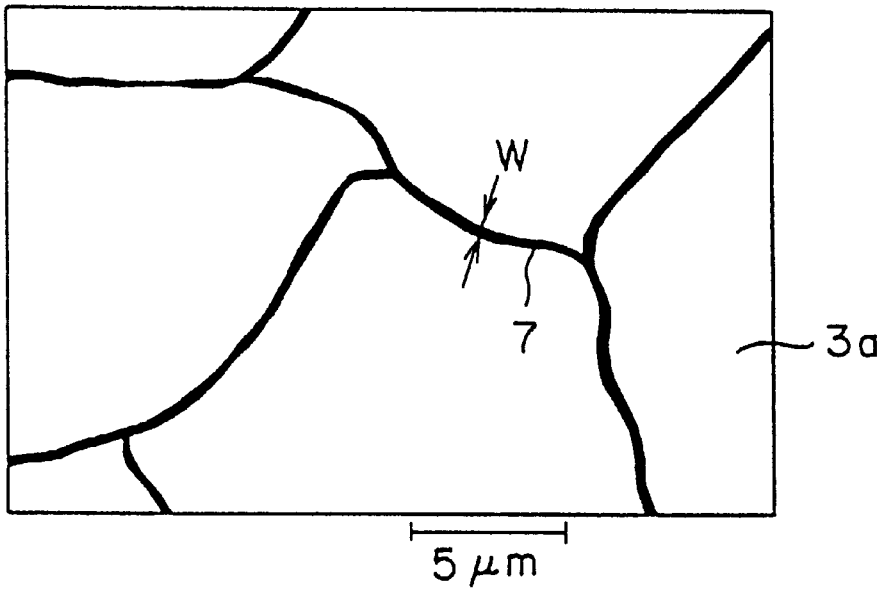

According to a preferred embodiment of the present invention, the above-described thermally-expandable ink layer has cracks on the surface thereof. FIGS. 4A and 4B show the cracked surface observed by a scanning electron microscope. FIG. 4A is an illustration of 2,000× magnification, and FIG. 4B is an illustration of 5,000× magnification.

In the present invention, the width (W) of the numerous cracks 7 as shown in FIG. 4B is from 10 nm to 5 micrometers, preferably from 100 nm to 3 micrometers.

When the width is in excess of 5 micrometers, a plane image formed on an image-receiving sheet by transfer pointing contains therein an increased percentage of void. Therefore, the image after expanded is to have drastically decreased strength. On the other hand, when the width is less than 10 nm, most of the cracks are closed while the heat transfer printing sheet is being preserved, or closed due to heat applied to the heat transfer printing sheet when heat transfer printing is conducted. For this reason, the effects of the cracks cannot be obtained. Further, the cracks 7 are required to have a depth whose numerical value is larger than the numerical value of the width W thereof. When the cracks 7 have a depth whose numerical value is smaller than the numerical value of the width thereof, the cracks cannot contribute to an improvement in the separation of the binder phase at the time of heat transfer printing.

Furthermore, the proportion of the surface area of the above cracks 7 to that of the thermally-expandable ink layer 3 is preferably from 0.5 to 20%, particularly from 2 to 10%. The proportion of the surface area of the cracks 7 can be obtained from an electron photomicrograph corresponding to the illustration of FIG. 4A; for example, the proportion of the surface area of the cracks to the surface area of 50 square micrometers in the photo is obtained by means of image processing. When this proportion is in excess of 20%, a plane image formed on an image-receiving sheet by heat transfer printing contains therein an increased percentage of void, so that the image after expanded is to have drastically decreased strength. On the other hand, when the proportion is less than 0.5%, most of the cracks are closed while the heat transfer printing sheet is being preserved, or closed due to heat applied to the heat transfer printing sheet when heat transfer printing is conducted. For this reason, the effects of the cracks cannot be obtained.

These cracks can be formed by coating, onto the substrate sheet, a coating liquid prepared by dispersing the resin which is used for forming the thermally-expandable ink layer 3 in water, and then drying the resulting coated layer. In this case, the selection of the conditions under which the coated layer is dried is important; the conditions should be properly controlled depending upon the resin used. There is no particular limitation on the type of the coating liquid prepared by dispersing a resin in water, and any coating liquid can be used as long as cracking can be caused on the coated layer when the drying conditions are properly controlled. Among various coating liquids, a particularly suitable one is an aqueous dispersion of a polyester resin which is prepared in accordance with the method for producing an aqueous dispersion described in Japanese Patent Publication No. 58092/1986. Specifically, this dispersion can be prepared in the following manner: a polyester resin containing a polycarboxylic acid moiety consisting of 40 to 99.5 mol % of an aromatic dicarboxylic acid having no metal sulfonate group, 59.5 to 0 mol % of an aliphatic or alicyclic dicarboxylic acid and 0.5 to 10 mol % of an aromatic dicarboxylic acid containing a metal sulfonate group, and a polyol moiety consisting of an aliphatic glycol having 2 to 8 carbon atoms and/or an alicyclic glycol having 15 to 12 carbon atoms, having a molecular weight of 2,500 to 30,000 and a softening point of 40 to 200° C. is mixed with a water-soluble organic compound having a boiling point of 60 to 200° C. Water is added to this mixture; or this mixture is added to water; or the above-described polyester resin is added to a mixture of water and the above water-soluble organic compound having a boiling point of 60 to 200° C., thereby obtaining the desired dispersion. When a layer formed by coating the aqueous polyester dispersion obtained in such a manner is dried, the layer tends to shrink. Cracking is therefore caused on the surface of the layer when the drying conditions are made optimum.

A process for producing raised images, using the above-described heat transfer printing sheet 30 for producing raised images will now be explained.

Figure 5A:
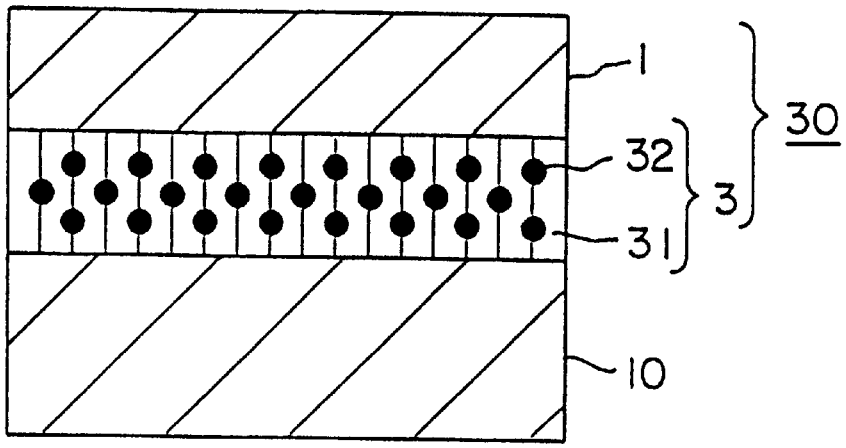
FIGS. 5A, 5B and 5C are illustrations explaining a process for producing a raised image on an image-receiving sheet by using the heat transfer printing sheet shown in FIG. 1.
Figure 5B:
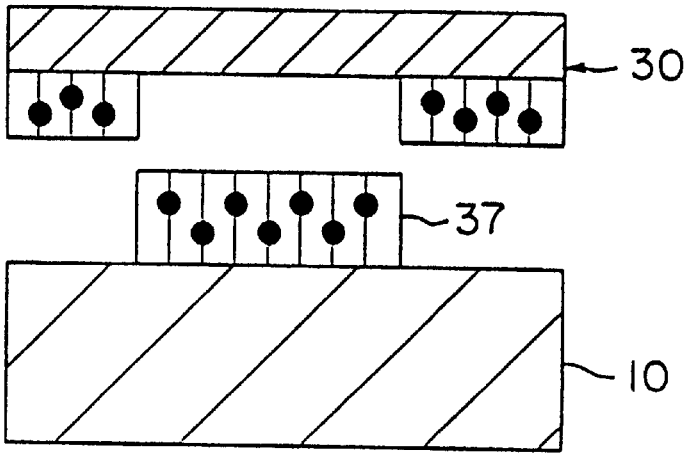

As shown in FIG. 5A, the above-described heat transfer printing sheet 30 is firstly superposed on an image-receiving sheet 10. Heat is applied image-wise to the thermally-expandable ink layer 3 provided in the heat transfer printing sheet 30, and the heat transfer printing sheet 30 is brought into pressure contact with the image-receiving sheet 10. Thereafter, the heat transfer printing sheet 30 is released from the image-receiving sheet 10, thereby separating image-wise the thermally-expandable ink layer 3 (37) from the heat transfer printing sheet 30 and transferring it to the image-receiving sheet 10 as shown in FIG. 5B. In this heat transfer printing, an image-receiving sheet selected from those which are in various shapes such as a sheet, a roll and a card can be used as the image-receiving sheet 10. The material for the image-receiving sheet 10 is not limited to natural fiber such as cellulose, and paper produced by using synthetic fiber such as Vinylon, nylon, polyester or polyacrylonitrile fiber, metallic fiber such as stainless steel fiber, inorganic fiber such as alumina or silicate fiber, carbon fiber, chitin fiber, or chitosan fiber can also be used. Examples of paper produced by using natural fiber include high-grade paper, medium-grade paper, copying paper, art paper, coated paper, craft paper, Kent paper, paperboard, drafting paper, card paper, pulp paper, glassine paper, newsprint paper and condenser paper. Further, a plastic film produced by using any of various thermoplastic resins, for instance, a polyethylene terephthalate film, a polyvinyl chloride film, a polyethylene naphthalate film or a polyimide film; or synthetic paper obtained by processing a thermoplastic resin into paper without subjecting the resin to a paper-making process, for example, "Yupo FPG-150" manufactured by Oji-Yuka Synthetic Paper Co., Ltd. can also be used as the image-receiving sheet 10.

Any of various known methods capable of controlling the amount of heat to be applied in accordance with an image information from a computer can be employed as a heating means, that is, as a thermal-energy-applying means, in order to transfer the image from the heat transfer printing sheet 30 to the image-receiving sheet 10. For instance, a thermal head for a heat-sensitive melt transfer printing system, used for a word processor, a thermal head for a heat-sensitive sublimation transfer printing system, used for a video printer, or a laser head used for a laser printer may be used as the heating means. Further, in the case where a layer capable of generating heat when an electric current is applied thereto is provided on the back surface of the heat transfer printing sheet, an electrothermal head for an electrothermal melt transfer printing system can also be used.

Figure 5C:
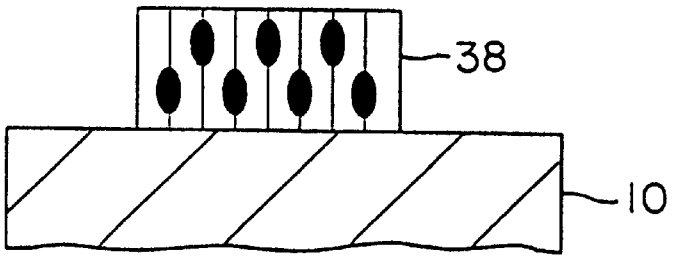

When light is applied to the thermally-expandable ink layer 37 which has been transferred image-wise to the image-receiving sheet 10, the ink layer expands. Three-dimensional raised images (expanded thermally-expandable ink layer 38) can thus be obtained as shown in FIG. 5C. It is preferable that the maximum-energy wavelength of the light to be applied to the thermally-expandable ink layer be in the range of 0.8 to 100 micrometers, particularly in the range of 1.0 to 4.0 micrometers. The absorption efficiency of light having a maximum-energy wavelength of longer than 100 micrometers in the thermally-expandable ink layer is considerably low, so that an extremely long time is needed to fully expand the ink layer by the application of such light.

Similarly, the absorption efficiency of light having a maximum-energy wavelength of shorter than 0.8 micrometers in the thermally-expandable ink layer is low, so that an extremely long time is required to sufficiently expand the ink layer by applying such light.

When the thermally-expandable ink layer 37 which has been transferred image-wise to the image-receiving sheet 10 is expanded by a method of heating other then the above-described light-application method, the resulting raised images are inferior to those obtained by the light-application method in both the height thereof and the adhesion to the image-receiving sheet (the resistance to touch reading). The reason for this may be as follows: when an image-receiving sheet on which images have been formed is brought into contact with a hot plate or a heating roller, the interfacial part between the images and the image-receiving sheet is firstly heated, so that only this part of the thermally-expandable ink layer is expanded. As a result, the transmission of the heat to the non-interfacial part of the ink layer is prevented, and the ink layer cannot be expanded entirely.

With respect to the percentage of void to be formed by the thermally-expandable micro-capsule contained in the three-dimensional raised images which are produced by the above-described light-application method, it is preferable to make the percentage of void to 90% or more and 99% or less, particularly 95% or more and 99% or less. When the percentage of void is less than 90%, the appearance of the raised images is not so different from that of the images before expanded. Therefore, the effects of the raised images cannot be fully obtained. On the other hand, when the percentage of void is in excess of 99%, the binder resin has the impaired effect of binding the particles of the micro-capsule, so that the raised images cannot have sufficiently high resistance to touch reading. It is noted that the term "percentage of void" used herein is defined by the following equation [1]:

$$\text{Percentage of Void}=(1-(\text{the density of the expanded thermally-expandable ink layer transferred to an image-receiving sheet}/\text{the density of the non-expanded thermally-expandable ink layer formed c)n the substrate sheet}))\times 100 \quad [1]$$

The parameters for controlling the percentage of void to be formed by the thermally-expandable micro-capsule include:

(1) the content of the thermally-expandable micro-capsule in the thermally-expandable ink layer, (2) the conditions under which light is applied to the thermally-expandable ink layer so as to expand it, and (3) the rate of the binder resin of the thermally-expandable ink layer to be absorbed by an image-receiving sheet.

Figure 2:
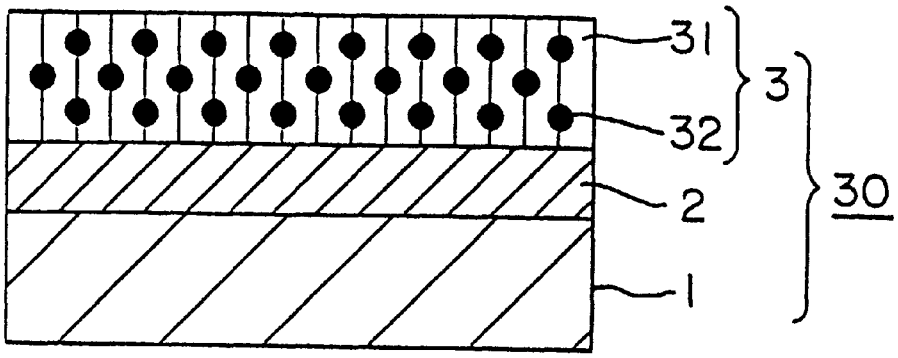
FIG. 2 is a diagrammatic sectional view of a preferable heat transfer printing sheet of the present invention, comprising a release-property-controlling layer.

In a preferred embodiment of the present invention, a release-property-controlling layer 2 is provided between the thermally-expandable ink layer 3 and the substrate sheet 1 of the heat transfer printing sheet 30 as shown in FIG. 2.

The release-property-controlling layer 2, which is provided so as to control the releasability of the thermally-expandable ink layer 3 from the heat transfer printing sheet 30 upon heating, is useful for separating only the image-forming part of the thermally-expandable ink layer 3 from the heat transfer printing sheet 30 and transferring it to an image-receiving sheet when heat transfer printing is conducted to obtain raised images by using the heat transfer printing sheet 30.

Figure 6A:
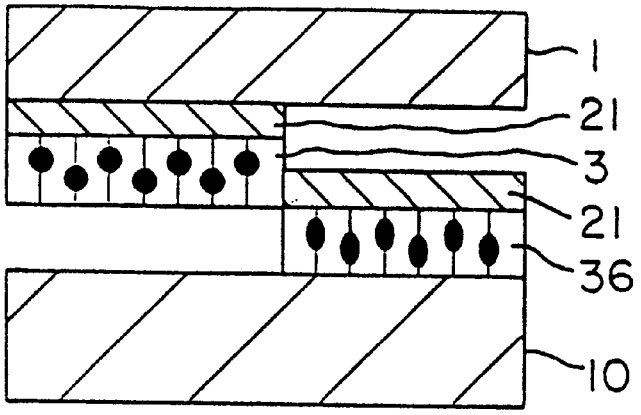
FIG. 6A is a diagrammatic sectional view showing the state of a heat transfer printing sheet comprising a release-property-controlling layer (release layer of a first type at the time when it is released from an image-receiving sheet in the course of heat transfer printing.
Figure 6B:
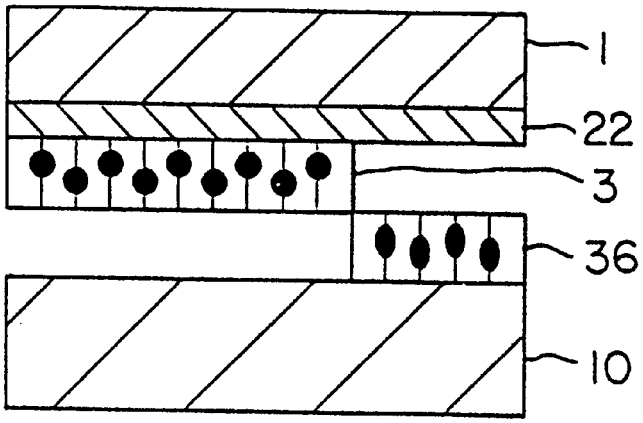
FIG. 6B is a diagrammatic sectional view showing the state of a heat transfer printing sheet comprising a release-property-controlling layer (parting layer) of a second type at the time when it is released from an image-receiving sheet in the course of heat transfer printing.
Figure 6C:
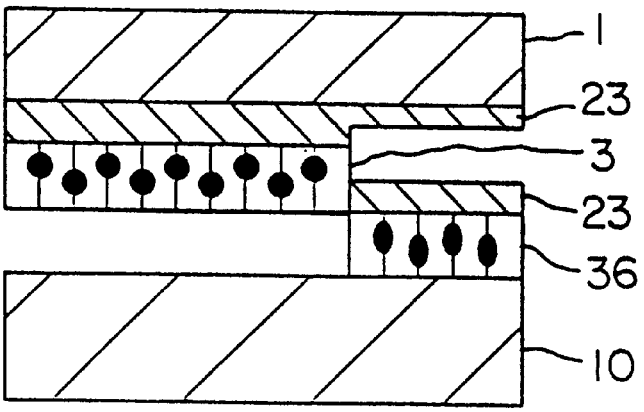
FIG. 6C is a diagrammatic sectional view showing the state of a heat transfer printing sheet comprising a release-property-controlling layer (separation layer) of a third type at the time when it is released from an image-receiving sheet in the course of heat transfer printing.

The release-property-controlling layer 2 includes the following three-types of layers: a release layer 21 as shown in FIG. 6A, which is released from the substrate sheet 1 and transferred to the image-receiving sheet 10 along with the thermally-expandable ink layer 36 which has been heated image-wise; a parting layer 22 as shown in FIG. 6B, which is useful to smoothly release, from the substrate sheet 1, the thermally-expandable ink layer 3 which has been heated image-wise at the interface between the ink layer 3 and the parting layer 22, that is, the parting layer 22 remains on the substrate sheet 1 and only the ink layer 36 is transferred to the image-receiving sheet 10; and a separation layer 23 as shown in FIG. 6C, which is separated into two when it is melted and its cohesive force is decreased due to heat which is applied to conduct transfer printing, whereby the thermally-expandable ink layer 3 which has been heated image-wise is released from the substrate sheet 1 as shown in the figure.

It is also possible to use the release layer 21 and the parting layer 22 in combination.

In the case where the release-property-controlling layer is the release layer 21 or the separation layer 23, the layer is also transferred to the image-receiving sheet along with the thermally-expandable ink layer 36 (3), and positioned on the outermost surface of the ink layer transferred. Therefore, in order to form such a release-property-controlling layer, it is necessary to select a resin which does not impair the expansibility of the thermally-expandable ink layer 36 (3). Further, the release layer 21 should be one which can serve as a protective layer for the resulting raised images but does not impair the touch of the raised images at the time of touch reading.

Examples of the material which can be used to form the parting layer 22 include those resins which themselves have release property such as silicone resin, fluororesin, polymethylpentene and polypropylene; varnishes of acrylic resin, linear polyester, vinyl chloride-vinyl acetate copolymers, polyvinyl butyral, polyvinyl acetal, polyvinyl acetate, nitrocellulose and cellulose acetate butyrate, added with a releasing agent selected from silicone resin, fluororesin, waxes and fatty acid amides; and the above-enumerated resins crosslinked by using various crosslinking agents. For example, any of the following can be used as the crosslinking agent: diisocyanates such as isophorone diisocyanate, xylylene diisocyanate, hexamethylene diisocyanate and diphenylmethane diisocyanate; adducts of diisocyanates with trimethylol propane, polyisocyanates of biuret or trimer type; crosslinking agents having epoxy, aziridine or oxazoline group; crosslinking agents such as melamine; and chelating agents such as aluminum, zinc, titanium and zirconium.

Crosslinked silicone resin, or acrylic or polyester resin containing a releasing agent crosslinked with a polyisocyanate is preferably used to form the parting layer 22. The application of a coating liquid for forming the parting layer 22 is conducted by a conventional means such as gravure coating or roll coating. The thickness of the parting layer 22 is preferably from 0.05 to 5.00 micrometers, more preferably from 0.10 to 2.00 micrometers. The resin for forming the release layer 21 is selected from those thermoplastic resins which do not lower the rate of heating the thermally-expandable ink layer 3 and which have film-forming properties. A matting agent, for example, a finely divided powder of an inorganic material such as silica, calcium carbonate, magnesium carbonate or aluminum hydroxide, or of an organic material such as polycarbonate, polyethylene or an ethylene-vinyl acetate copolymer, can also be dispersed in the release layer 21 so as to make the resulting raised images highly readable with the fingers.

Further, by incorporating the previously-mentioned thermally-expandable micro-capsule into the release layer 21, and expanding the micro-capsule together with the thermally-expandable ink layer which has been transferred image-wise to the image-receiving sheet, the readability of the resulting raised images with the fingers can be improved.

Examples of the thermoplastic resin which can be used for forming the release layer 21 include acrylic resin, linear polyester, vinyl chloride-vinyl acetate copolymers, vinyl chloride-vinylidene chloride copolymers, polyvinyl butyral, polyvinyl acetal, polyvinyl acetate, polyamide, urethane, acrylonitrile, polyisobutyrene, neoprene and natural rubber, and a solution or dispersion of any of these resins is used to form the release layer 21. Preferable resins are vinyl chloride/vinylidene chloride copolymers, acrylonitrile and acrylic resin which can be a barrier layer to a hydrocarbon which is used as the expanding agent in the thermally-expandable ink layer 3. A solution or dispersion of any of the above resins is coated by a conventional means such as gravure coating, roll coating or air-knife coating to form the release layer 21. The thickness of the release layer 21 is preferably from 0.05 to 5.00 micrometers, more preferably from 0.10 to 2.00 micrometers.

The resin for forming the separation layer 23 is one whose cohesive force is decreased when melted by heat which is applied to transfer the thermally-expandable ink layer 3 from the heat transfer printing sheet 30, and can be selected from natural waxes, synthetic waxes, thermoplastic resins and the like. Examples of the resin which can be used for forming the separation layer 23 include a variety of waxes such as microcrystalline wax, carnauba wax, paraffin wax, Fischer-Tropsh wax, various low-molecular-weight polyethylenes, Japan wax, beeswax, spermaceti, insect wax, wool wax, shellac wax, candelilla wax, petrolatum, partially-modified waxes, fatty acid esters, fatty acid amides and silicone wax, polyvinyl butyral, polyvinyl acetal, polyvinyl acetate, polyamide, polyester, acrylic resin and polyurethane. These resins can be used either singly or in combination. Of these, low-molecular-weight polyethylenes are preferred. The resin is melted by heating, or dissolved in a solvent by heating, or dissolved or dispersed in a solvent, and the resultant is coated by a conventional means such as gravure coating, roll coating or air-knife coating to form the separation layer 23. The thickness of the separation layer 23 is preferably from 0.05 to 5.00 micrometers, more preferably from 0.10 to 2.00 micrometers.

Further, in order to fully control the release property by the release-property-controlling layer, it is possible to crosslink, by the use of various crosslinking agents, the above-described resins to be used for forming the release-property-controlling layer. Examples of the crosslinking agent which can be used for this purpose include diisocyanates such as isophorone diisocyanate, xylylene diisocyanate, hexamethylene diisocyanate and diphenylmethane diisocyanate; adducts of diisocyanates with trimethylol propane, polyisocyanates of biuret or trimer types; crosslinking agents having epoxy, aziridine or oxazoline group; crosslinking agents such as melamine; and chelating agents such as aluminum, zinc, titanium and zirconium.

In order to crosslink the release-property-controlling layer, a known catalyst can be used depending upon the individual crosslinking reaction which will be occurred. For example, a tin catalyst such as di-n-butyltin dilaurate or tin dioctoate, an amine catalyst such as tetramethylbutanediamine or N,N,N',N'-tetramethyl-1,3-butanediamine, or 1,4-diaza-bicyclo[2,2,2]octane can be used for the crosslinking reaction of isocyanate.

Further, in the case where the resins used for forming the thermally-expandable ink layer 3 and the release-property-controlling layer are dyeable with a thermally-diffusible pigment, a thermally-diffusible pigment; of a desired color can be incorporated into the release-property-controlling layer.

When such a pigment is added, the thermally-expandable ink layer 3 can be colored with the desired color because the thermally-diffusible pigment added to the release-property-controlling layer is diffused by heat which is applied to dry the thermally-expandable ink layer 3 coated. Thus, the thermally-expandable ink layer 3 formed by coating a liquid which is prepared by dispersing or dissolving the thermally-expandable micro-capsule (or the expanding agent) and the binder resin in water, and drying the resulting layer can be dyed with a thermally-diffusible pigment which cannot be dissolved or is hardly dispersed in water.

There is no particular limitation on the thermally-diffusible pigment, and any conventionally-known dyes can be used. For example, MS Red G, Macrolex Red Violet R, Ceres Red 7B, Samaron Red HBSL, Resolin Red F3BS and the like can be mentioned as preferable red dyes; Phorone Brilliant Yellow 6GL, PTY-52, Macrolex Yellow 6G and the like can be mentioned as preferable yellow dyes; and Kayaset Blue 714, Waxoline Blue AP-FW, Phorone Brilliant Blue S-R, MS Blue 100 and the like can be mentioned as preferable blue dyes. Not only one of these thermally-diffusible pigments but also a mixture of any two or more of them can be used in order to obtain a desired color tone.

Figure 3:
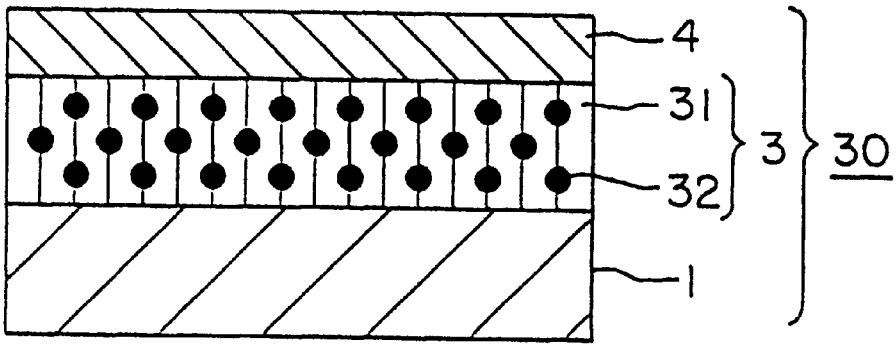
FIG. 3 is a diagrammatic sectional view of a preferable heat transfer printing sheet of the present invention, comprising a heat-sensitive adhesive layer.

Further, a heat-sensitive adhesive layer 4 can also be provided on the surface of the thermally-expandable ink layer 3 as shown in FIG. 3. The heat-sensitive adhesive layer 4 is provided so as to make it possible to transfer the thermally-expandable ink layer 3 at a relatively low temperature. This is advantageous because when heat transfer printing is conducted at a high temperature at which the expansion of the thermally-expandable ink layer is occurred, there may be a case where the thermally-expandable micro-capsule expands not only to the direction of the height but also to the horizontal direction, impairing the resistance to touch reading of the resulting raised images.

Examples of the material which can be used for forming the heat-sensitive adhesive layer 4 include waxes such as microcrystalline wax, carnauba wax and paraffin wax; mixed rubbers such as acrylic rubber, styrene-butadiene rubber, ethylene-propylene rubber, isoprene rubber, butadiene rubber, nitrile rubber and chlorinated butyl rubber; unvulcanized natural rubber; vinyl resins such as polyvinyl acetate and polyvinyl chloride; polyester resins such as polyethylene terephthalate and polybutylene terephthalate; and thermoplastic resins such as an ethylene-vinyl copolymer and polyamide. These materials can be used either singly or in combination. When the thermally-expandable micro-capsule is incorporated into the heat-sensitive adhesive layer 4, the adhesive layer 4 is expanded when heated, and the readability of the resulting raised images with the fingers can thus be improved.

It is preferable that those cracks which are previously explained in connection with the thermally-expandable ink layer be present on the surface of the heat-sensitive adhesive layer 4.

In this case, it is preferable that the depth of the cracks present on the surface of the heat-sensitive adhesive layer 4 be equal to the thickness of the adhesive layer 4. Moreover, it is preferable that those cracks which are explained previously be present also on the surface of the thermally-expandable ink layer which is laid under the heat-sensitive adhesive layer 4. In this case, however, the cracks on the heat-sensitive adhesive layer 4 and those on the thermally-expandable ink layer 3 are not required to be continuous, and the cracks on these two layers can be formed independently (in general, the cracks are formed independently). The cracks can be formed in accordance with the previously-described method.

In the case where a thermal head is used as a heating means in the course of the heat transfer printing which is conducted by using the heat transfer printing sheet 30 to form raised images on the image-receiving sheet, heat is applied to the surface of the substrate sheet 1, opposite to the surface on which the thermally-expandable ink layer 3 is formed. On this surface to which heat is applied by a thermal head, it is preferable to provide a heat-resistant slip layer so as to impart heat resistance and/or slip properties to the surface. The heat-resistant slip layer contains as basic components a resin which has heat resistance, and a material which can act as a thermal-releasing agent or a lubricant. To crosslink various thermoplastic resins by a known crosslinking agent is an effective method for improving the heat resistance of the resins. For instance, in the case where the thermoplastic resin has hydroxyl group in the side chain thereof or at the end of the molecule thereof, a crosslinking agent such as polyisocyanate can be used. When a crosslinking agent is used, a catalyst is employed, as needed.

Next, a heat transfer printing sheet further comprising a hot-melt coloring layer, which is another embodiment of the present invention, will be explained.

Figure 7:
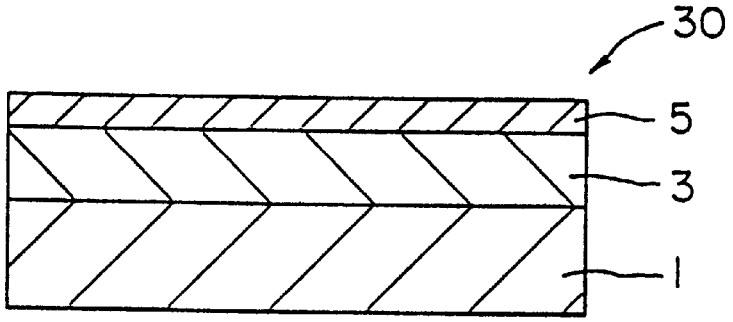
FIG. 7 is a diagrammatic sectional view of a preferable heat transfer printing sheet according to the present invention, comprising a hot-melt coloring layer formed on a thermally-expandable ink layer.

The heat transfer printing sheet 30 shown in FIG. 7 comprises the above-described substrate sheet 1, the above-described thermally-expandable ink layer 3 formed on one surface of the substrate sheet 1, and a hot-melt coloring layer 5 formed on the thermally-expandable ink layer 3, comprising a coloring material and a hot-melt binder.

A wax is suitable as the hot-melt binder to be incorporated into the hot-melt coloring layer 5. Specific examples of the wax include microcrystalline wax, carnauba wax, paraffin wax, Fischer-Tropsh wax, various low-molecular-weight polyethylenes, Japan wax, beeswax, spermaceti, insect wax, wool wax, shellac wax, candelilla wax, petrolatum, partially-modified waxes, fatty acid esters and fatty acid amides.

The number-average molecular weight of the wax which is used as the hot-melt binder is from 200 to 1,000, preferably from 400 to 1,000.

It is necessary that the relationship between the melting point, mp2, of the hot-melt binder contained in the hot-melt coloring layer 5 and the melting point, mp1, of the hot-melt binder contained in the above-described thermally-expandable ink layer 3 be mp1>mp2. In addition, the difference between these melting points (mp1−mp2) is preferably 30° C. or more, more preferably in the range of 30 to 100° C. If such a relationship is not fulfilled, it is impossible to transfer, by the application of a small amount of printing energy, only the surface of the hot-melt coloring layer 5 to form so-called inked letters, and, at the same time, to transfer, by the application of a large amount of printing energy, both the remaining hot-melt coloring layer 5 and the thermally-expandable ink layer 3 to form images which will be made into raised letters later.

Carbon black or a water-dispersible pigment is used as the coloring material to be incorporated into the hot-melt coloring layer 5. Specific examples of the water-dispersible pigment include "FUJI SP RED 5126" and "FUJI SP BLUE 6002" manufactured by Fuji Pigment Co., Ltd.

Such a coloring material is incorporated into the hot-melt coloring layer 5 in an amount of approximately 1 to 10 parts by weight (dry basis) for 100 parts by weight of the hot-melt binder. The thickness of the hot-melt coloring layer 5 is approximately 0.5 to 5.0 micrometers.

When a small amount, for instance, from 1% to 30% by weight, preferably from 5% to 20% by weight, of the resin which is used for forming the above-described thermally-expandable ink layer 3 is incorporated into the hot-melt coloring layer 5, the adhesion between the thermally-expandable ink layer 3 and the image-receiving sheet 10 can be improved. When the amount of this resin is too small, the effect of improving the adhesion cannot be sufficiently obtained. On the other hand, when the amount of the resin is too large, the transferability of the hot-melt coloring layer 5 at the time when only the inked letters are printed is adversely affected by the resin.

Figure 8:
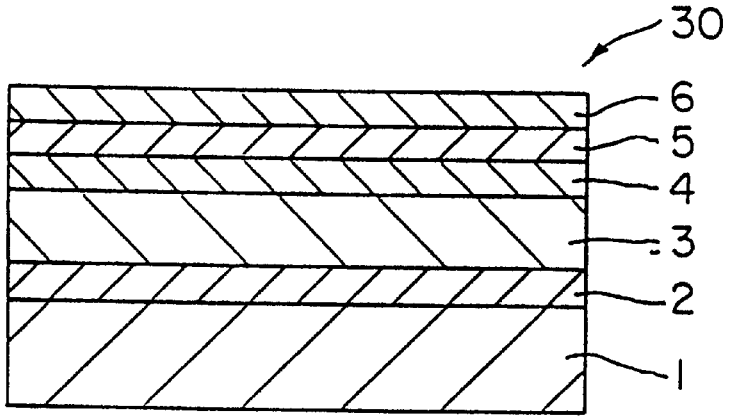
FIG. 8 is a diagrammatic sectional view of a heat transfer printing sheet obtained by providing a release layer and a heat-sensitive adhesive layer in the heat transfer printing sheet shown in FIG. 7.

In another preferred embodiment of the present invention, the above-described release-property-controlling layer 2 is provided, as shown in FIG. 8, between the thermally-expandable ink layer 3 and the substrate sheet 1 of the heat transfer printing sheet 30. Further, it is also preferable to provide the above-described heat-sensitive adhesive layer 4 between the thermally-expandable ink layer 3 and the hot-melt coloring layer 5, and to provide a hot-melt layer 6 on the surface of the hot-melt coloring layer 5.

The hot-melt layer 6 is provided in order to prevent the staining of images, which tends to be caused when the hot-melt coloring layer 5 is transferred. The hot-melt layer 6 contains as a main component a hot-melt material having a number-average molecular weight of 1,000 or less. Specific examples of such a hot-melt material include microcrystalline wax, carnauba wax and paraffin wax. The thickness of the hot-melt layer 6 is approximately 0.1 to 2.0 micrometers.

In the case where a thermal head is used as a heating means in the course of the heat transfer printing which is conducted by using the heat transfer printing sheet 30 to form raised images on the image-receiving sheet, heat is applied to the surface of the substrate sheet 1, opposite to the surface on which the thermally-expandable ink layer 3 is formed. As mentioned previously, it is preferable to provide, on this surface to which heat is applied by a thermal head, the heat-resistant slip layer so as to impart heat resistance and/or slip properties to the surface.

A process for producing raised images in which the above-described heat transfer printing sheet 30 for producing raised images is used will now be explained. The process according to the present invention is characterized in that both raised letters for the blind and inked letters (to be read by the eyes, in contrast to raised letters read with the fingers) for the seeing (having normal eyesight) can be produced by using one piece of the heat transfer printing sheet 30 in one printing operation. However, the formation of inked letters and that of raised letters will be explained separately in order to give a better understanding of the process of the present invention.

(1) Formation of Inked Letters

The above-described heat transfer printing sheet: 30 is superposed on an image-receiving sheet 10. First heating is then conducted as follows in order to obtain inked letters: the heat transfer printing sheet 30 is heated image-wise to a temperature at which the hot-melt coloring layer 5 provided in the heat transfer printing sheet 30 can be melt-transferred, and brought into pressure contact with the image-receiving sheet 10. Thereafter, the heat transfer printing sheet 30 is released from the image-receiving sheet 10, thereby separating image-wise the hot-melt coloring layer 5 from the heat transfer printing sheet 30 and transferring it to the image-receiving sheet 10. By this first heating, the thermally-expandable ink layer 3 is not melt-transferred to the image-receiving sheet 10. Namely, the first heating is a step of heating the heat transfer printing sheet 30 to a temperature at which only the hot-melt coloring layer 5 is melt-transferred and the thermally-expandable ink layer 3 is not melt-transferred to the image-receiving sheet 10. It is noted that the relationship between mp1 and mp2 is, of course, mp1>mp2 as described previously.

(2) Formation of Raised Letters

The heat transfer printing sheet 30 is superposed on the image-receiving sheet 10. Second heating is then conducted as follows in order to obtain raised letters: the heat transfer printing sheet 30 is heated image-wise to a temperature at which not only the hot-melt coloring layer 5 but also the thermally-expandable ink layer 3 can be transferred, and brought into pressure contact with the image-receiving sheet 10. Thereafter, the heat transfer printing sheet 30 is released from the image-receiving sheet 10, thereby separating image-wise both the hot-melt coloring layer 5 and the thermally-expandable ink layer 3 from the heat transfer printing sheet 30 and transferring them to the image-receiving sheet 10. At this time, the hot-melt coloring layer 5 is infiltrated into the image-receiving sheet 10, and the thermally-expandable ink layer 3 softened is transferred thereon. Namely, the second heating is a step of heating the heat transfer printing sheet 30 to a temperature at which both the hot-melt coloring layer 5 and the thermally-expandable ink layer 3 can be transferred to the image-receiving sheet 10. After this, thermal energy is applied to the image which has been transferred to the image-receiving sheet 10 so as to expand it. The thermally-expandable ink layer 3 which has been transferred image-wise to the image-receiving sheet 10 is thus expanded, thereby obtaining three-dimensional raised images such as raised letters. Any of various means can be adopted to apply thermal energy to the transferred images; for example, heating using an oven, hot-air heating using a heating wire, heating by applying infrared light or laser beam, electromagnetic heating, or heating by bringing the image-receiving sheet into contact with a heating roller can be employed. Of these, heating by applying light is particularly preferred as mentioned previously. Preferable light is one which has a maximum-energy wavelength of 1.0 to 4.0 micrometers.

It is noted that since the hot-melt coloring layer 5 is present in the state of being infiltrated into the image-receiving sheet 10, it gives rise to a kind of sealing effect.

Figure 9:
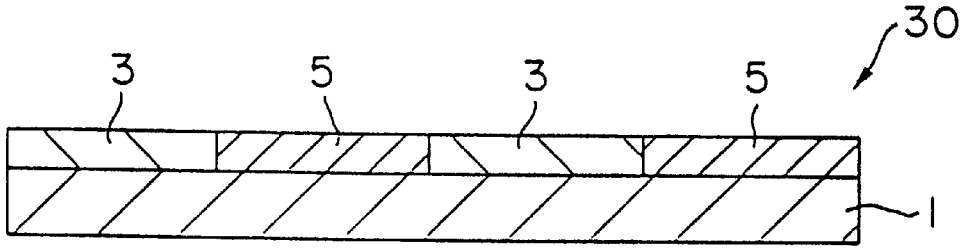
FIG. 9 is a diagrammatic sectional view of a preferable heat transfer printing sheet according to the present invention, comprising a hot-melt coloring layer and a thermally-expandable ink layer provided in sequence on a substrate sheet.

The heat transfer printing sheet 30 shown in FIG. 9 comprises the above-described thermally-expandable ink layer 3 and hot-melt coloring layer 5 which are provided in sequence on one surface of the above-described substrate sheet 1. The expression "provided in sequence" as used herein means that the thermally-expandable ink layer 3 and the hot-melt coloring layer 5 are provided on the substrate sheet 1 by being arranged closely and alternately on almost the same level without being overlapped each other.

FIG. 9 shows, as one embodiment, the heat transfer printing sheet 30 in which the thermally-expandable ink layer 3 and the hot-melt coloring layer 5 are alternately arranged in the longer direction of the substrate sheet 1. However, these two layers can also be alternately arranged in the width direction of the substrate sheet 1 when the substrate sheet 1 is broad.

As in the case of the previously-mentioned heat transfer printing sheet, it is preferable, also in the heat transfer printing sheet shown in FIG. 9, to provide the release-property-controlling layer between the substrate sheet and the thermally-expandable ink layer, and the heat-sensitive adhesive layer on the surface of the thermally-expandable ink layer. Further, it is also preferable to provide a surface-coating layer on the surface of the hot-melt coloring layer 5 in order to prevent the background from being stained, and to provide the above-described release-property-controlling layer between the hot-melt coloring layer 5 and the substrate sheet 1. The surface-coating layer provided so as to prevent the staining of the background comprises as a main component a hot-melt material having a number-average molecular weight of 1,000 or less. Specific examples of such a hot-melt material include microcrystalline wax, carnauba wax, paraffin wax, Fischer-Tropsh wax, various low-molecular-weight polyethylenes, Japan wax, beeswax, spermaceti, insect wax, wool wax, shellac wax, candelilla wax, petrolatum, partially-modified waxes, fatty acid esters and fatty acid amides. The thickness of the surface-coating layer is approximately 0.1 to 5.0 micrometers.

A process for producing raised images in which the above-described heat transfer printing sheet 30 for producing raised images is used will be explained. The process according to the present invention is characterized in that raised letters for the blind and inked letters for the seeing can be produced side by side by using one piece of the heat transfer printing sheet 30 and one thermal head, in respective printing operations. However, the formation of inked letters and that of raised letters will be explained below separately.

(1) Formation of Inked Letters

The above-described heat transfer printing sheet 30 is superposed on an image-receiving sheet 10. The back surface of the substrate sheet 1, opposite to the surface on which the hot-melt coloring layer 5 is present, is heated image-wise to a temperature at which the hot-melt coloring layer 5 can be melt-transferred, and the heat transfer printing sheet 30 is brought into pressure contact with the image-receiving sheet 10. Thereafter, the heat transfer printing sheet 30 is released from the image-receiving sheet 10, thereby separating image-wise the hot-melt coloring layer 5 from the heat transfer printing sheet 30 and transferring it to the image-receiving sheet 10.

(2) Formation of Raised Letters

The heat transfer printing sheet 30 is superposed on the image-receiving sheet 10. The back surface of the substrate sheet 1, opposite to the surface on which the thermally-expandable ink layer 3 is present, is heated image-wise to a temperature at which the thermally-expandable ink layer 3 can be transferred, and the heat transfer printing sheet 30 is brought into pressure contact with the image-receiving sheet 10. Thereafter, the heat transfer printing sheet 30 is released from the image-receiving sheet 10, thereby separating image-wise the thermally-expandable ink layer 3 from the heat transfer printing sheet 30 and transferring it to the image-receiving sheet 10.

Thereafter, thermal energy is applied to the image which has been transferred to the image-receiving sheet 10 so as to expand the image. The thermally-expandable ink layer 3 which has been transferred image-wise to the image-receiving sheet 10 is thus expanded, thereby obtaining three-dimensional raised images such as raised letters. The heating means which is employable in this step is as mentioned previously.

The present invention will now be explained more specifically by referring to the following examples. However, the present invention is not limited to or limited by the examples. Throughout the examples, the units "part(s)" and "%" mean "part(s) by weight" and "% by weight", respectively, unless otherwise indicated.

EXAMPLE I-1

A polyethylene terephthalate film having a thickness of 6.0 micrometers, whose one surface had been subjected to a heat-resistance-imparting treatment was used as a substrate sheet. A homogeneous coating liquid for forming a thermally-expandable ink layer, having the following formulation was coated, by means of gravure printing, onto the surface of the substrate sheet, opposite to the surface which had been made heat resistant, so that the thickness of the ink layer after dried would be 30.0 micrometers, and then dried. Thus, a heat transfer printing sheet in a continuous film according to the present invention was obtained.

<Formulation of Coating Liquid for Forming Thermally-Expandable Ink Layer>

| | |
|---|---|
| Aqueous dispersion of polyester ("Vylonal MD-1930" manufactured by Toyobo Co., Ltd., solids content: 30%, number-average molecular weight of the resin: approximately 25,000) | 40 parts |
| Thermally-expandable micro-capsule ("MATSUMOTO MICRO SPHERE F-20VS" manufactured by Matsumoto Yushi-Seiyaku Company, Ltd.) | 15 parts |
| Water | 20 parts |

EXAMPLE I-2

The procedure of Example I-1 was repeated except that the coating liquid for forming a thermally-expandable ink layer used in Example I-1 was replaced by a coating liquid for forming a thermally-expandable ink layer, having the following formulation, thereby obtaining a heat transfer printing sheet of the present invention.

<Formulation of Coating Liquid for Forming Thermally-Expandable Ink Layer>

| | |
|---|---|
| Polyester resin ("PLACCEL 210" manufactured by Daicel Chemical Industries, Ltd., number-average molecular weight: approximately 1,000) | 20 parts |
| Thermally-expandable micro-capsule ("MATSUMOTO MICRO SPHERE F-30VS" manufactured by Matsumoto Yushi-Seiyaku Company, Ltd.) | 25 parts |
| Toluene | 200 parts |

EXAMPLE I-3

The procedure of Example I-1 was repeated except that the coating liquid for forming a thermally-expandable ink layer used in Example I-1 was replaced by a coating liquid for forming a thermally-expandable ink layer, having the following formulation, thereby obtaining a heat transfer printing sheet of the present invention.

<Formulation of Coating Liquid for Forming Thermally-Expandable Ink Layer>

| | |
|---|---|
| Polyester resin ("PLACCEL H1P" manufactured by Daicel Chemical Industries, Ltd., number-average molecular weight: approximately 10,000) | 20 parts |
| Thermally-expandable micro-capsule ("MATSUMOTO MICRO SPHERE F-30VS" manufactured by Matsumoto Yushi-Seiyaku Company, Ltd.) | 25 parts |
| Toluene | 200 parts |

EXAMPLE I-4

A homogeneous coating liquid for forming a heat-sensitive adhesive layer, having the following formulation was coated, by means of gravure printing, onto the surface of the thermally-expandable ink layer of the heat transfer printing sheet prepared in accordance with the procedure of Example I-1 so that the thickness of the adhesive layer after dried would be 2.0 micrometers, and then dried. Thus, a heat transfer printing sheet according to the present invention was obtained.

<Formulation of Coating Liquid for Forming Heat-Sensitive Adhesive Layer>

| | |
|---|---|
| Aqueous dispersion of polyester ("Vylonal MD-1930" manufactured by Toyobo Co., Ltd., solids content: 30%) | 20 parts |
| Water | 10 parts |

EXAMPLE I-5

A polyethylene terephthalate film having a thickness of 6.0 micrometers, whose one surface had been subjected to a heat-resistance-imparting treatment was used as a substrate sheet. A coating liquid for forming a release-property-controlling layer, having the following formulation was coated, by means of gravure printing, onto the surface of the substrate sheet, opposite to the surface which had been made heat resistant, so that the thickness of the layer after dried would be 1.0 micrometer, and then dried. The same coating liquid for forming a thermally-expandable ink layer as in Example I-1 was coated, by means of gravure printing, onto the release-property-controlling layer so that the thickness of the ink layer after dried would be 30.0 micrometers, and then dried. Thus, a heat transfer printing sheet in a continuous film according to the present invention was obtained.

<Formulation of Coating Liquid for Forming Release-Property-Controlling Layer>

| | |
|---|---|
| Acrylic resin ("Dianal BR-85" manufactured by Mitsubishi Rayon Co., Ltd.) | 10 parts |
| Methyl ethyl ketone | 50 parts |
| Toluene | 50 parts |

EXAMPLE I-6

The procedure of Example I-5 was repeated except that the coating liquid for forming a release-property-controlling layer used in Example I-5 was replaced by a coating liquid for forming a release-property-controlling layer, having the following formulation, thereby obtaining a heat transfer printing sheet of the present invention.

<Formulation of Coating Liquid for Forming Release-Property-Controlling Layer>

| | |
|---|---|
| Acrylic resin ("Dianal BR-65" manufactured by Mitsubishi Rayon Co., Ltd.) | 100 parts |
| "Kayaset Blue 714" (manufactured by Nippon Kayaku Co., Ltd.) | 5 parts |
| Methyl ethyl ketone | 500 parts |
| Toluene | 500 parts |

EXAMPLE I-7

The procedure of Example I-1 was repeated except that the coating liquid for forming a thermally-expandable ink layer used in Example I-1 was replaced by a coating liquid for forming a thermally-expandable ink layer, having the following formulation, thereby obtaining a heat transfer printing sheet of the present invention.

<Formulation of Coating Liquid for Forming Thermally-Expandable Ink Layer>

| | |
|---|---|
| Aqueous dispersion of polyester ("Vylonal MD-1930" manufactured by Toyobo Co., Ltd., solids content: 30%, number-average molecular weight of the resin: 25,000) | 40 parts |
| Thermally-expandable micro-capsule ("MATSUMOTO MICRO SPHERE F-20VS" manufactured by Matsumoto Yushi-Seiyaku Company, Ltd.) | 15 parts |
| Aqueous dispersion of carbon black ("PSM Black #423" manufactured by Mikuni Color Ltd., solids content: 30%) | 30 parts |
| Water | 20 parts |

EXAMPLE I-8

The procedure of Example I-1 was repeated except that the coating liquid for forming a thermally-expandable ink layer used in Example I-1 was replaced by a coating liquid for forming a thermally-expandable ink layer, having the following formulation, thereby obtaining a heat transfer printing sheet of the present invention.

<Formulation of Coating Liquid for Forming Thermally-Expandable Ink Layer>

| | |
|---|---|
| Polyvinyl alcohol (number-average molecular weight: 30,000) | 10 parts |
| Thermally-expandable micro-capsule ("MATSUMOTO MICRO SPHERE F-20VS" manufactured by Matsumoto Yushi-Seiyaku Company, Ltd.) | 15 parts |
| Water | 200 parts |

COMPARATIVE EXAMPLE I-1

The procedure of Example I-1 was repeated except that the coating liquid for forming a thermally-expandable ink layer used in Example I-1 was replaced by a coating liquid for forming a thermally-expandable ink layer, having the following formulation, thereby obtaining a comparative heat transfer printing sheet.

<Formulation of Coating Liquid for Forming Thermally-Expandable Ink Layer>

| | |
|---|---|
| Aqueous dispersion of polyester ("Vylonal MD-1930" manufactured by Toyobo Co., Ltd., solids content: 30%, number-average molecular weight of the resin: 25,000) | 40 parts |
| Thermally-decomposable expanding agent (sodium hydrogen carbonate) | 15 parts |
| Water | 20 parts |

COMPARATIVE EXAMPLE I-2

The procedure of Example I-1 was repeated except that the coating liquid for forming a thermally-expandable ink layer used in Example I-1 was replaced by a coating liquid for forming a thermally-expandable ink layer, having the following formulation, thereby obtaining a comparative heat transfer printing sheet.

<Formulation of Coating Liquid for Forming Thermally-Expandable Ink Layer>

| | |
|---|---|
| Aqueous dispersion of carnauba wax ("WE-95" manufactured by Konishi Co., Ltd., solids content: 30%) | 40 parts |
| Thermally-expandable micro-capsule ("MATSUMOTO MICRO SPHERE F-20VS" manufactured by Matsumoto Yushi-Seiyaku Company, Ltd.) | 15 parts |
| Water | 20 parts |

COMPARATIVE EXAMPLE I-3

The procedure of Example I-1 was repeated except that the coating liquid for forming a thermally-expandable ink layer used in Example I-1 was replaced by a coating Liquid for forming a thermally-expandable ink layer, having the following formulation, thereby obtaining a comparative heat transfer printing sheet.

<Formulation of Coating Liquid for Forming Thermally-Expandable Ink Layer>

| | |
|---|---|
| Polyvinyl alcohol (number-average molecular weight: 500) | 5 parts |
| Thermally-expandable micro-capsule ("MATSUMOTO MICRO SPHERE F-20VS" manufactured by Matsumoto Yushi-Seiyaku Company, Ltd.) | 6 parts |
| Water | 100 parts |

COMPARATIVE EXAMPLE I-4

The procedure of Example I-1 was repeated except that the coating liquid for forming a thermally-expandable ink layer used in Example I-1 was replaced by a coating liquid for forming a thermally-expandable ink layer, having the following formulation, thereby obtaining a comparative heat transfer printing sheet.

<Formulation of Coating Liquid for Forming Thermally-Expandable Ink Layer>

| | |
|---|---|
| Polyvinyl alcohol (number-average molecular weight: 100,000) | 5 parts |
| Thermally-expandable micro-capsule ("MATSUMOTO MICRO SPHERE F-20VS" manufactured by Matsumoto Yushi-Seiyaku Company, Ltd.) | 6 parts |
| Water | 100 parts |

COMPARATIVE EXAMPLE I-5

The procedure of Example I-1 was repeated except that the coating liquid for forming a thermally-expandable ink layer used in Example I-1 was replaced by a coating Liquid for forming a thermally-expandable ink layer, having the following formulation, thereby obtaining a comparative heat transfer printing sheet.

<Formulation of Coating Liquid for Forming Thermally-Expandable Ink Layer>

| | |
|---|---|
| Polyester resin ("PLACCEL H4" manufactured by Daicel Chemical Industries, Ltd., number-average | 20 parts |

-continued

| | |
|---|---|
| molecular weight: 40,000) | |
| Thermally-expandable micro-capsule ("MATSUMOTO MICRO SPHERE F-20VS" manufactured by Matsumoto Yushi-Seiyaku Company, Ltd.) | 25 parts |
| Toluene | 200 parts |

[Heat Transfer Printing Test]

Each of the heat transfer printing sheets obtained in the above Examples and Comparative Examples was superposed on a sheet of high-grade paper having a thickness of 150 micrometers, serving as an image-receiving sheet, with the thermally-expandable ink layer of the heat transfer printing sheet faced the surface of the paper. Heat was then applied to the back surface of the heat transfer printing sheet by using a thermal head ("KMT-85-6MPD2-HTV"), thereby conducting heat transfer printing. The printing conditions were as follows: the voltage applied to the thermal head was 12.0 V; the printing speed was 33.3 ms/line; and the pulse width of the voltage applied was 16.0 ms/line. In this step of printing, an image information was so controlled that picture elements of approximately 170 square micrometers, obtainable by the application of heat using the thermal head, would form a circle having a diameter of approximately 1 mm, whereby dot elements having a diameter of approximately 1 mm with which raised letters would be produced were thermally transferred to the image-receiving sheet.

Thereafter, the heat transfer printing sheet was released from the image-receiving sheet, and the image-receiving sheet was heated in an oven at 100° C. for one minute to expand the thermally-expandable ink layer which had been transferred thereto, thereby obtaining raised letters. The following properties were evaluated in accordance with the following methods. The results are shown in Table I.

It is noted that the term "dot elements" as used herein means individual dots arranged in a raised letter for the blind, consisting of 6 dots each having a diameter of approximately 1 mm.

(1) Separability of Ink Layer

The heat transfer printing sheet was released from the image-receiving sheet after heat was applied by the thermal head. At this time, the degree of unfavorable transfer of a non-heated part, surrounding the heated part, of the thermally-expandable ink layer to the image-receiving sheet together with the heated part, caused because the heated part is not clearly separated from the heated part, was evaluated in accordance with the following standard.:

◎: The heated part of the thermally-expandable ink layer was perfectly separated from the non-heated part, and transferred to the image-receiving sheet; the boundary between the heated part and the non-heated part was clear.

○: The heated part of the thermally-expandable ink layer was almost perfectly separated from the non-heated part, and transferred to the image-receiving sheet; the raised letters obtained were highly readable with the fingers.

Δ: The heated part of the thermally-expandable ink layer was not clearly separated from the non-heated part, so that clear-cut dot elements could not be obtained; the raised letters had impaired readability with the fingers.

×: The heated part of the thermally-expandable ink layer was not separated from the non-heated part, and almost all of the ink layer was transferred to the image-receiving sheet; it was difficult to recognize the dot elements with the fingers.

(2) Height of Raised Letters

After the images which had been formed on the image-receiving sheet by the heat transfer printing were expanded by the application of heat, the height of the resulting raised letters was measured by a micrometer.

○: The height was 200 micrometers or more; the raised letters were highly readable with the fingers.

Δ: The height was in the range of 100 to 200 micrometers; it was possible to know with the fingers the existence of the dot elements, but difficult to recognize individual dots arranged in a raised letter consisting of 6 dot elements, so that it was difficult to read the raised letters with the fingers.

×: The height was less than 100 micrometers; it was possible to know with the fingers the existence of the raised images on the image-receiving sheet, but difficult to recognize them as dot elements of raised letters.

(3) Strength of Expanded Images

◎: The thermally expanded dot elements were neither broken nor separated from the image-receiving sheet when touched with the fingers; the readability of the raised letters was not changed at all by repeated touch reading.

○: The thermally expanded dot elements were scarcely broken or separated from the image-receiving sheet when touched with the fingers; the readability of the raised letters was not greatly changed by repeated touch reading.

Δ: The thermally expanded dot elements were broken or partially separated from the image-receiving sheet by repeated touch reading; the initial readability of the raised letters was gradually impaired.

×: The thermally expanded dot elements were readily broken when touched with the fingers; it was difficult to know the existence of the dot elements with the fingers.

TABLE I

| | Separability of Ink Layer | Height of Raised Letters | Strength of Expanded Images |
|---|---|---|---|
| Example I-1 | ◎ | ○ | ◎ |
| Example I-2 | ◎ | ○ | ◎ |
| Example I-3 | ◎ | ○ | ◎ |
| Example I-4 | ◎ | ○ | ◎ |
| Example I-5 | ◎ | ○ | ◎ |
| Example I-6 | ◎ | ○ | ◎ |
| Example I-7 | ◎ | ○ | ◎ |
| Example I-8 | ○ | ○ | ○ |
| Comp. Ex. I-1 | ◎ | x | x |
| Comp. Ex. I-1 | Δ | x | x |
| Comp. Ex. I-2 | ○ | Δ | Δ |
| Comp. Ex. I-3 | x | Δ | x |
| Comp. Ex. I-4 | x | Δ | x |

EXAMPLE II-1

A polyethylene terephthalate film having a thickness of 6.0 micrometers, whose one surface had been subjected to a heat-resistance-imparting treatment was used as a substrate sheet. A coating liquid for forming a release-property-controlling layer, having the following formulation was coated, by means of gravure printing, onto the surface of the substrate sheet, opposite to the surface which had been made heat resistant, so that the thickness of the layer after dried would be 1.0 micrometer, and then dried. A coating liquid for forming a thermally-expandable ink layer, having the following formulation was coated, by means of gravure printing, onto the release-property-controlling layer so that the thickness of the ink layer after dried would be 30.0 micrometers, and then dried. Thus, a heat transfer printing sheet in a continuous film according to the present invention was obtained.

<Formulation of Coating Liquid for Forming Release-Property-Controlling Layer>

| | |
|---|---|
| Polymethacrylate resin ("Dianai BR-85" manufactured by Mitsubishi Rayon Co., Ltd.) | 10 parts |
| Methyl ethyl ketone | 50 parts |
| Toluene | 50 parts |

<Formulation of Coating Liquid for Forming Thermally-Expandable Ink Layer>

| | |
|---|---|
| Aqueous dispersion of polyester ("Vylonal MD-1930" manufactured by Toyobo Co. Ltd., solids content: 30%, number-average molecular weight of the resin: approximately 25,000) | 40 parts |
| Thermally-expandable micro-capsule ("MATSUMOTO MICRO SPHERE F-20VS" manufactured by Matsumoto Yushi-Seiyaku Company, Ltd.) | 15 parts |
| Water | 20 parts |

EXAMPLE II-2

The procedure of Example II-1 was repeated except that the coating liquid for forming a release-property-controlling layer used in Example II-1 was replaced by a coating liquid for forming a release-property-controlling layer, having the following formulation, thereby obtaining a heat transfer printing sheet of the present invention.

<Formulation of Coating Liquid for Forming Release-Layer-Controlling Layer>

| | |
|---|---|
| Polymethacrylate resin ("Dianal BR-85" manufactured by Mitsubishi Rayon Co., Ltd.) | 100 parts |
| "Kayaset Blue 714" (manufactured by Nippon Kayaku Co., Ltd.) | 5 parts |
| Methyl ethyl ketone | 500 parts |
| Toluene | 500 parts |

EXAMPLE II-3

The procedure of Example II-1 was repeated except that the coating liquid for forming a thermally-expandable ink layer used in Example II-1 was replaced by a coating liquid for forming a thermally-expandable ink layer, having the following formulation, thereby obtaining a heat transfer printing sheet of the present invention.

<Formulation of Coating Liquid for Forming Thermally-Expandable Ink Layer>

| | |
|---|---|
| Polyester resin ("PLACCEL H1P" manufactured by Daicel Chemical Industries, Ltd., number-average molecular weight: approximately 10,000) | 20 parts |
| Thermally-expandable micro-capsule | 25 parts |

-continued

| | |
|---|---|
| ("MATSUMOTO MICRO SPHERE F-20VS" manufactured by Matsumoto Yushi-Seiyaku Company, Ltd.) | |
| Toluene | 200 parts |

EXAMPLE II-4

A homogeneous coating liquid for forming a heat-sensitive adhesive layer, having the following formulation was coated, by means of gravure printing, onto the surface of the thermally-expandable ink layer of the heat transfer printing sheet prepared in accordance with the procedure of Example II-1 so that the thickness of the adhesive layer after dried would be 2.0 micrometers, and then dried. Thus, a heat transfer printing sheet according to the present invention was obtained.

<Formulation of Coating Liquid for Forming Heat-Sensitive Adhesive Layer>

| | |
|---|---|
| Aqueous dispersion of polyester ("Vylonal MD-1930" manufactured by Toyobo Co., Ltd., solids content: 30%) | 20 parts |
| Water | 10 parts |

EXAMPLE II-5

The procedure of Example II-1 was repeated except that the coating liquid for forming a release-property-controlling layer used in Example II-1 was replaced by a coating liquid for forming a release-property-controlling layer, having the following formulation, thereby obtaining a heat transfer printing sheet of the present invention.

<Formulation of Coating Liquid for forming Release-Property-Controlling Layer>

| | |
|---|---|
| Bisphenol A polycarbonate (manufactured by JANSSEN CHIMICA) | 5 parts |
| Chloroform | 100 parts |

EXAMPLE II-6

The procedure of Example II-1 was repeated except that the coating liquid for forming a release-property-controlling layer used in Example II-1 was replaced by a coating liquid for forming a release-property-controlling layer, having the following formulation, thereby obtaining a heat transfer printing sheet of the present invention.

<Formulation of Coating Liquid for Forming Release-Property-Controlling Layer>

| | |
|---|---|
| Polyester resin ("Vylon 600" manufactured by Toyobo Co., Ltd.) | 10 parts |
| Methyl ethyl ketone | 50 parts |
| Toluene | 50 parts |

COMPARATIVE EXAMPLE II-1

The procedure of Example II-1 was repeated except that the release-property-controlling layer was not formed, thereby obtaining a comparative heat transfer printing sheet.

[Heat Transfer Printing Test]

Each of the heat transfer printing sheets obtained in the above Examples and Comparative Example was superposed on a sheet of high-grade paper having a thickness of 150 micrometers, serving as an image-receiving sheet, with the thermally-expandable ink layer of the heat transfer printing sheet faced the surface of the paper. Heat was then applied to the back surface of the heat transfer printing sheet by using a thermal head ("KMT-85-6MPD2-HTV"), thereby conducting heat transfer printing. The printing conditions were as follows: the voltage applied to the thermal head was 12.0 V; the printing speed was 33.3 ms/line; and the pulse width of the voltage applied was 16.0 ms/line. In this step of printing, an image information was so controlled that picture elements of approximately 170 square micrometers, obtainable by the application of heat using the thermal head, would form a circle having a diameter of approximately 1 mm, whereby dot elements having a diameter of approximately 1 mm with which raised letters would be produced were thermally transferred to the image-receiving sheet.

Thereafter, the heat transfer printing sheet was released from the image-receiving sheet, and the image-receiving sheet was heated in an oven at 100° C. for one minute to expand the thermally-expandable ink layer which had been transferred thereto, thereby obtaining raised letters. The following properties were evaluated in accordance with the following methods. The results are shown in Table II.

It is noted that the term "dot elements" as used herein means individual dots arranged in a raised letter for the blind, consisting of 6 dots each having a diameter of approximately 1 mm.

(1) Separability of Ink Layer

The heat transfer printing sheet was released from the image-receiving sheet after heat was applied by the thermal head. At this time, the degree of unfavorable transfer of a non-heated part, surrounding the heated part, of the thermally-expandable ink layer to the image-receiving sheet together with the heated part, caused because the heated part is not clearly separated from the non-heated part, was evaluated in accordance with the following standard:

◎: The heated part of the thermally-expandable ink layer was perfectly separated from the non-heated part, and transferred to the image-receiving sheet; the boundary between the heated part and the non-heated part was clear.

○: The heated part of the thermally-expandable ink layer was almost perfectly separated from the non-heated part, and transferred to the image-receiving sheet; the raised letters obtained were highly readable with the fingers.

Δ: The heated part of the thermally-expandable ink layer was not clearly separated from the non-heated part, so that clear-cut dot elements could not be obtained; the raised letters had impaired readability with the fingers.

×: The heated part of the thermally-expandable ink layer was not separated from the non-heated part, and almost all of the ink layer was transferred to the image-receiving sheet; it was difficult to recognize the dot elements with the fingers.

(2) Height of Raised Letters

After the images which had been formed on the image-receiving sheet by the heat transfer printing were expanded by the application of heat, the height of the resulting raised letters was measured by a micrometer.

○: The height was 200 micrometers or more; the raised letters were highly readable with the fingers.

Δ: The height was in the range of 100 to 200 micrometers; it was possible to know with the fingers the existence of the dot elements, but difficult to recognize individual dots arranged in a raised letter consisting of 6 dot elements, so that it was difficult to read the raised letters with the fingers.

×: The height was less than 100 micrometers; it was possible to know with the fingers the existence of the raised images on the image-receiving sheet, but difficult to recognize them as dot elements of raised letters.

(3) Strength of Expanded Images

○: The thermally expanded dot elements were scarcely broken or separated from the image-receiving sheet when touched with the fingers; the readability of the raised letters was not changed by repeated touch reading.

Δ: The thermally expanded dot elements were broken or partially separated from the image-receiving sheet by repeated touch reading; the initial readability of the raised letters was gradually impaired.

×: The thermally expanded dot elements were readily broken when touched with the fingers; i-t was difficult to know the existence of the dot elements with the fingers.

(4) Releasability of Heat Transfer Printing Sheet

◎: It was easy to release the heat transfer printing sheet from the image-receiving sheet after the image-wise application of heat was conducted; the substrate sheet of the printing sheet was neither stretched nor broken.

○: As compared with the heat transfer printing sheet which was evaluated as "◎", a greater force was needed to release the heat transfer printing sheet from the image-receiving sheet after the image-wise application of heat was conducted; however, the substrate sheet was neither stretched nor broken.

Δ: A great force was needed to release the heat transfer printing sheet from the image-receiving sheet after the image-wise application of heat was conducted; the substrate sheet was stretched.

×: An extremely great force was needed to release the heat transfer printing sheet from the image-receiving sheet after the image-wise application of heat was conducted; the substrate sheet was broken.

Table II

| | Separability of Ink Layer | Height of Raised Letters | Strength of Expanded Images | Releasability |
|---|---|---|---|---|
| Example II-1 | ○ | ○ | ○ | ◎ |
| Example II-2 | ○ | ○ | ○ | ◎ |
| Example II-3 | ○ | ○ | ○ | ◎ |
| Example II-4 | ◎ | ○ | ○ | ◎ |
| Example II-5 | ◎ | ○ | ○ | ○ |
| Example II-6 | ○ | ○ | ○ | ◎ |
| Example III-1 | ○ | ○ | ○ | x |

EXAMPLE III-1

A polyethylene terephthalate film having a thickness of 6.0 micrometers, whose one surface had been subjected to a heat-resistance-imparting treatment was used as the substrate sheet 1. A homogeneous coating liquid 1 for forming a thermally-expandable ink layer, having the following formulation was coated, by means of reverse-roll coating, onto the surface of the substrate sheet, opposite to the surface which had been made heat resistant, so that the thickness of the ink layer after dried would be 30 micrometers, and then dried, thereby forming a thermally-expandable ink layer 3.

<Formulation of Coating Liquid 1 for Forming Thermally-Expandable Ink Layer>

| | |
|---|---|
| Aqueous dispersion of polyester ("Vylonal MD-1930" manufactured by Toyobo Co., Ltd., solids content: 30%, number-average molecular weight of the resin: 25,000) | 40 parts |
| Thermally-expandable micro-capsule ("MATSUMOTO MICRO SPHERE F-20VS" manufactured by Matsumoto Yushi-Seiyaku Company, Ltd.) | 15 parts |
| Water | 20 parts |

Subsequently, a coating liquid 1 for forming a hot-melt coloring layer, having the following formulation. was coated, by means of direct gravure coating, onto the thermally-expandable ink layer 3 so that the thickness of the coloring layer after dried would be 2.0 micrometers, and then dried, thereby forming a hot-melt coloring layer 5.

<Formulation of Coating Liquid 1 for Forming Hot-Melt Coloring Layer>

| | |
|---|---|
| Aqueous solution of carnauba wax ("WE-95" manufactured by Konishi Co., Ltd., solids content: 30%) | 100 parts |
| Aqueous dispersion of red pigment ("FUJI SP RED 5126" manufactured by Fuji Pigment Co., Ltd.) | 10 parts |
| Water | 50 parts |

Thereafter, a coating liquid 1 for forming a hot-melt layer, having the following formulation was coated, by means of direct gravure coating, onto the hot-melt coloring layer 5 so that the thickness of the layer after dried would be 1.0 micrometer, and then dried, thereby forming a hot-melt layer 6.

<Formulation of Coating Liquid 1 for Forming Hot-Melt Layer>

| | |
|---|---|
| Aqueous solution of carnauba wax ("WE-95" manufactured by Konishi Co., Ltd., solids content: 30%) | 100 parts |
| Water | 50 parts |

The heat transfer printing sheet thus obtained was superposed on a sheet of high-grade paper having a thickness of 150 micrometers, serving as an image-receiving sheet, with the hot-melt layer 6 of the heat transfer printing sheet faced the surface of the paper. Heat was then applied to the back surface of the heat transfer printing sheet by using a thermal head (KMT-85-6MPD2-HTV), thereby transferring both a group of desired inked letters and a group of desired images to be made into raised letters.

In this process, the group of inked letters and that of images to be made into raised letters were simultaneously transferred to the image-receiving sheet in one printing operation by controlling the printing energy to be supplied, that is, by changing the pulse width of the voltage to be applied to the thermal head.

Namely, the area of the heat transfer printing sheet with which the group of inked letters would be formed was heated by the thermal head under the following printing conditions: the voltage applied to the thermal head was 12.0 V; the printing speed was 33.3 ms/line; and the pulse width of the voltage applied was 6.0 ms/line. Only the hot-melt coloring layer 5 (including the hot-melt layer 6 formed thereon) was thus transferred to the image-receiving sheet, and the group of desired inked letters was printed. On the other hand, the area of the heat transfer printing sheet with which the group of images to be made into raised letters would be formed was heated by the thermal head under the following printing conditions: the voltage applied to the thermal head was 12.0 V; the printing speed was 33.3 ms/line; and the pulse width of the voltage applied was 16.0 ms/line. Both the hot-melt coloring layer 5 (including the hot-melt layer 6 formed thereon) and the thermally-expandable ink layer 3 were transferred to the image-receiving sheet to form dot elements having a diameter of approximately 1 mm with which raised letters would be formed.

After the heat transfer printing sheet was released from the image-receiving sheet, infrared rays with a maximum-energy wavelength of 1.2 micrometers were applied to the image-receiving sheet for 20 seconds by an infrared heater (a short-wavelength-infrared radiator "ZKB 60(3/80G" manufactured by Heraeus Kabushiki Kaisha) which was placed at a distance of 5 cm. By this, the thermally-expandable ink layer 3 which had been transferred image-wise to the image-receiving sheet was expanded to produce a group of raised letters. A sample of Example III-1 having both the group of inked letters and that of raised letters was thus obtained.

With respect to the group of raised letters (the raised area) on this sample, the "height of the raised letters" and the "strength of the expanded images" were evaluated. As a result, the raised letters were found to have a height of 200 micrometers or more, and confirmed to be highly readable with the fingers. Further, regarding the "strength of the expanded images", it was confirmed that the thermally expanded dot elements were scarcely broken or separated from the image-receiving sheet when touched with the fingers and that the readability of the raised letters was not changed by repeated touch reading.

With respect to the group of inked letters (the inked area) on the sample, it was confirmed that the letters printed were extremely sharp. In other words, it was confirmed that the picture elements for forming the inked letters had been exactly transferred to the image-receiving sheet by the image-wise application of energy.

EXAMPLE III-2

The procedure of Example III-1 was repeated except that the coating liquid 1 for forming a thermally-expandable ink layer used in Example III-1 was replaced by a coating liquid 2 for forming a thermally-expandable ink layer, having the following formulation, thereby obtaining a heat transfer printing sheet of the present invention.

<Formulation of Coating Liquid 2 for Forming Thermally-Expandable Ink Layer>

| | |
|---|---|
| Polyester resin ("PLACCEL H1P" manufactured by Daicel Chemical Industries, Ltd., number-average molecular weight: 10,000) | 20 parts |
| Thermally-expandable micro-capsule ("MATSUMOTO MICRO SPHERE F-30VS" manufactured by Matsumoto Yushi-Seiyaku Company, Ltd.) | 25 parts |
| Toluene | 200 parts |

By the use of the heat transfer printing sheet thus obtained, the same heat transfer printing test as in Example III-1 was carried out, thereby obtaining a sample of Example III-2 having both a group of raised letters and that of inked letters.

With respect to the group of raised letters (the raised area) on this sample, the "height of the raised letters" and the "strength of the expanded images" were evaluated. As a result, the raised letters were found to have a height of 200 micrometers or more, and confirmed to be highly readable with the fingers. Further, regarding the "strength of the expanded images", it was confirmed that the thermally expanded dot elements were scarcely broken or separated from the image-receiving sheet when touched with the fingers and that the readability of the raised letters was not changed by repeated touch reading.

With respect to the group of inked letters (the inked area) on the sample, it was confirmed that the letters printed were extremely sharp. In other words, it was confirmed that the picture elements for forming the inked letters had been exactly transferred to the image-receiving sheet by the image-wise application of energy.

EXAMPLE III-3

The procedure of Example III-1 was repeated except that the coating liquid 1 for forming a thermally-expandable ink layer used in Example III-1 was replaced by a coating liquid 3 for forming a thermally-expandable ink layer, having the following formulation, thereby obtaining a heat transfer printing sheet of the present invention.

<Formulation of Coating Liquid 3 for Forming Thermally-Expandable Ink Layer>

| | |
|---|---|
| Aqueous dispersion of polyester ("Vylonal MD-1930" manufactured by Toyobo Co., Ltd., solids content: 30%, number-average molecular weight of the resin: 25,000) | 40 parts |
| Thermally-decomposable expanding agent (sodium hydrogen carbonate) | 15 parts |
| Water | 20 parts |

By the use of the heat transfer printing sheet thus obtained, the same heat transfer printing test as in Example III-1 was carried out, thereby obtaining a sample of Example III-3 having both a group of raised letters and that of inked letters.

With respect to the group of raised letters (the raised area) on this sample, the "height of the raised letters" and the "strength of the expanded images" were evaluated. As a result, the raised letters were found to have a height of 200 micrometers or more, and confirmed to be highly readable with the fingers. Further, regarding the "strength of the expanded images", it was confirmed that the thermally expanded dot elements were scarcely broken or separated from the image-receiving sheet when touched with the fingers and that the readability of the raised letters was not changed by repeated touch reading.

With respect to the group of inked letters (the inked area) on the sample, it was confirmed that the letters printed were extremely sharp. In other words, it was confirmed that the picture elements for forming the inked letters had been exactly transferred to the image-receiving sheet by the image-wise application of energy.

EXAMPLE III-4

The procedure of Example III-1 was repeated except that a release-property-controlling layer 2 having a thickness of 1.0 micrometer was provided between the substrate sheet 1 and the thermally-expandable ink layer 3 in such a manner in that a coating liquid for forming the release-property-controlling layer, having the following formulation was coated, by means of gravure printing, onto the substrate sheet 1 and then dried, and that a heat-sensitive adhesive layer 4 having a thickness of 2.0 micrometers was provided between the thermally-expandable ink layer 3 and the hot-melt coloring layer 5 in such a manner in that a coating liquid for forming the heat-sensitive adhesive layer, having the following formulation was coated, by means of gravure coating, onto the thermally-expandable ink layer 3 and then dried, thereby obtaining a heat transfer printing sheet of the present invention.

<Formulation of Coating Liquid for Forming Release-Property-Controlling Layer>

| | |
|---|---|
| Polymethacrylate resin ("Dianal BR-85" manufactured by Mitsubishi Rayon Co., Ltd.) | 10 parts |
| Methyl ethyl ketone | 50 parts |
| Toluene | 50 parts |
| <Formulation of Coating Liquid for Forming Heat-Sensitive Adhesive Layer> | |
| Aqueous dispersion of polyester ("Vylonal MD-1930" manufactured by Toyobo Co., Ltd., solids content: 30%, number-average molecular weight of the resin: 25,000) | 20 parts |
| Water | 10 parts |

By the use of the heat transfer printing sheet thus obtained, the same heat transfer printing test as in Example III-1 was carried out, thereby obtaining a sample of Example III-4 having both a group of raised letters and that of inked letters.

With respect to the group of raised letters (the raised area) on this sample, the "height of the raised letters" and the "strength of the expanded images" were evaluated. As a result, the raised letters were found to have a height of 200 micrometers or more, and confirmed to be highly readable with the fingers. Further, regarding the "strength of the expanded images", it was confirmed that the thermally expanded dot elements were scarcely broken or separated from the image-receiving sheet when touched with the fingers and that the readability of the raised letters was not changed by repeated touch reading.

With respect to the group of inked letters (the inked area) on the sample, it was confirmed that the letters printed were extremely sharp. In other words, it was confirmed that the picture elements for forming the inked letters had been exactly transferred to the image-receiving sheet by the image-wise application of energy.

EXAMPLE IV-1

A polyethylene terephthalate film having a thickness of 6.0 micrometers, whose one surface had been subjected to a heat-resistance-imparting treatment was used as a substrate sheet 1. A homogeneous coating liquid 1 for forming a thermally-expandable ink layer, having the following formulation was coated, by means of direct gravure coating, onto the surface of the substrate sheet, opposite to the surface which had been made heat resistant, so that the thickness of the ink layer after dried would be 30.0 micrometers, and then dried, thereby forming a thermally-expandable ink layer 3. In this step of coating, the coating liquid was not coated onto a predetermined area on the substrate sheet so that the thermally-expandable ink layer and a hot-melt coloring layer which would be formed after this would be provided in sequence on the substrate sheet.

<Formulation of Coating Liquid 1 for Forming Thermally-Expandable Ink Layer>

| | |
|---|---|
| Aqueous dispersion of polyester ("Vylonal MD-1930" manufactured by Toyobo Co., Ltd., solids content: 30%, number-average molecular weight of the resin: 25,000) | 40 parts |
| Thermally-expandable micro-capsule ("MATSUMOTO MICRO SPHERE F-20VS" manufactured by Matsumoto Yushi-Seiyaku Company, Ltd.) | 15 parts |
| Water | 20 parts |

Subsequently, a coating liquid 1 for forming a hot-melt coloring layer, having the following formulation was coated, by means of direct gravure coating, onto the non-coated area on the substrate sheet, next to the thermally-expandable ink layer 3 so that the thickness of the coloring layer after dried would be 2.0 micrometers, and then dried, thereby forming a hot-melt coloring layer 5. The thermally-expandable ink layer and the hot-melt coloring layer were thus provided in sequence on the substrate sheet as shown in FIG. 9.

<Formulation of Coating Liquid 1 for Forming Hot-Melt Coloring Layer>

| | |
|---|---|
| Aqueous solution of carnauba wax ("WE-95" manufactured by Konishi Co., Ltd., solids content: 30%) | 100 parts |
| Aqueous dispersion of red pigment ("FUJI SP RED 5126" manufactured by Fuji Pigment Co., Ltd.) | 10 parts |
| Water | 50 parts |

The heat transfer printing sheet thus obtained was superposed on a sheet of high-grade paper having a thickness of 150 micrometers, serving as an image-receiving sheet, with the hot-melt coloring layer 5 and the thermally-expandable ink layer 3 of the heat transfer printing sheet faced the surface of the paper. Heat was then applied to the back surface of the heat transfer printing sheet by using a thermal head (KMT-85-6MPD2-HTV), whereby a group of desired inked letters and that of desired images to be made into raised letters were successively transferred to the image-receiving sheet.

In this step of transfer printing, the heat transfer printing sheet and the thermal head were properly slided so as to adjust the position of the group of inked images and that of the group of images (non-expanded) to be made into raised letters.

The printing conditions were as follows: the voltage applied to the thermal head was 12.0 V; the printing speed was 33.3 ms/line; and the pulse width of the voltage applied was 6.0 ms/line (for printing the group of inked letters) or 16 ms/line (for transferring the group of images to be made into raised letters). It is noted that raised letters were formed by transferring dot elements having a diameter of approximately 1 mm.

After the heat transfer printing sheet was released from the image-receiving sheet, infrared rays with a maximum-energy wavelength of 1.2 micrometers were applied to the image-receiving sheet for 20 seconds by an infrared heater (a short-wavelength-infrared radiator "ZKB 600/80G" manufactured by Heraeus Kabushiki Kaisha) which was placed at a distance of 5 cm. By this, the thermally-expandable ink layer 3 which had been transferred to the image-receiving sheet was expanded to produce a group of raised letters. A sample of Example IV-1 having both the group of inked letters and that of raised letters was thus obtained.

With respect to the group of raised letters (the raised area) on this sample, the "height of the raised letters" and the "strength of the expanded images" were evaluated. As a result, the raised letters were found to have a height of 200 micrometers or more, and confirmed to be highly readable with the fingers. Further, regarding the "strength of the expanded images", it was confirmed that the thermally expanded dot elements were scarcely broken or separated from the image-receiving sheet when touched with the fingers and that the readability of the raised letters was not changed by repeated touch reading.

With respect to the group of inked letters (the inked area) on the sample, it was confirmed that the letters printed were extremely sharp. In other words, it was confirmed that the picture elements for forming the inked letters had been exactly transferred to the image-receiving sheet by the image-wise application of energy.

EXAMPLE IV-2

The procedure of Example IV-1 was repeated except that the coating liquid 1 for forming a thermally-expandable ink layer used in Example IV-1 was replaced by a coating liquid 2 for forming a thermally-expandable ink layer, having the following formulation, thereby obtaining a heat transfer printing sheet of the present invention.

<Formulation of Coating Liquid 2 for Forming Thermally-Expandable Ink Layer>

| | |
|---|---|
| Polyester resin ("PLACCEL H1P" manufactured by Daicel Chemical Industries, Ltd., number-average molecular weight: 10,000) | 20 parts |
| Thermally-expandable micro-capsule ("MATSUMOTO MICRO SPHERE F-30VS" manufactured by Matsumoto Yushi-Seiyaku Company, Ltd.) | 25 parts |
| Toluene | 200 parts |

By the use of the heat transfer printing sheet thus obtained, the same heat transfer printing test as in Example IV-1 was carried out, thereby obtaining a sample of Example IV-2 having both a group of raised letters and that of inked letters.

With respect to the group of raised letters (the raised area) on this sample, the "height of the raised letters" and the "strength of the expanded images" were evaluated. As a result, the raised letters were found to have a height of 200 micrometers or more, and confirmed to be highly readable with the fingers. Further, regarding the "strength of the expanded images", it was confirmed that the thermally expanded dot elements were scarcely broken or separated from the image-receiving sheet when touched with the fingers and that the readability of the raised letters was not changed by repeated touch reading.

With respect to the group of inked letters (the inked area) on the sample, it was confirmed that the letters printed were extremely sharp. In other words, it was confirmed that the picture elements for forming the inked letters had been exactly transferred to the image-receiving sheet by the image-wise application of energy.

EXAMPLE IV-3

The procedure of Example IV-1 was repeated except that the coating liquid 1 for forming a thermally-expandable ink layer used in Example IV-1 was replaced by a coating liquid 3 for forming a thermally-expandable ink layer, having the following formulation, thereby obtaining a heat transfer printing sheet of the present invention.

<Formulation of Coating Liquid 3 for Forming Thermally-Expandable Ink Layer>

| | |
|---|---|
| Aqueous dispersion of polyester ("Vylonal MD-1930" manufactured by Toyobo Co., Ltd., solids content: 30%, number-average molecular weight of the resin: 25,000) | 40 parts |
| Thermally-decomposable expanding agent (sodium hydrogen carbonate) | 15 parts |
| Water | 20 parts |

By the use of the heat transfer printing sheet thus obtained, the same heat transfer printing test as in Example IV-1 was carried out, thereby obtaining a sample of Example IV-3 having both a group of raised letters and that of inked letters.

With respect to the group of raised letters (the raised area) on this sample, the "height of the raised letters" and the "strength of the expanded images" were evaluated. As a result, the raised letters were found to have a height of 200 micrometers or more, and confirmed to be highly readable with the fingers. Further, regarding the "strength of the expanded images", it was confirmed that the thermally expanded dot elements were scarcely broken or separated from the image-receiving sheet when touched with the fingers and that the readability of the raised Letters was not changed by repeated touch reading.

With respect to the group of inked letters (the inked area) on the sample, it was confirmed that the letters printed were extremely sharp. In other words, it was confirmed that the picture elements for forming the inked letters had been exactly transferred to the image-receiving sheet by the image-wise application of energy.

EXAMPLE IV-4

The procedure of Example IV-1 was repeated except that a release-property-controlling layer 2 having a thickness of 1.0 micrometer was provided between the substrate sheet 1 and the thermally-expandable ink layer 3 in such a manner in that a coating liquid for forming the release-property-controlling layer 2, having the following formulation was coated, by means of gravure printing, onto the substrate sheet 1 and then dried, and that a heat-sensitive adhesive layer 4 having a thickness of 2.0 micrometers was provided on the thermally-expandable ink layer 3 in such a manner in that a coating liquid for forming the heat-sensitive adhesive layer, having the following formulation was coated, by means of gravure printing, onto the thermally-expandable ink layer 3 and then dried, thereby obtaining a heat transfer printing sheet of the present invention.

<Formulation of Coating Liquid for Forming Release-Property-Controlling Layer>

| | |
|---|---|
| Polymethacrylate resin ("Dianal BR-85" manufactured by Mitsubishi Rayon Co., Ltd.) | 10 parts |
| Methyl ethyl ketone | 50 parts |
| Toluene | 50 parts |

<Formulation of Coating Liquid for Forming Heat-Sensitive Adhesive Layer>

| | |
|---|---|
| Aqueous dispersion of polyester ("Vylonal MD-1930" manufactured by Toyobo Co., Ltd., solids content: 30%, number-average molecular weight of the resin: 25,000) | 20 parts |
| Water | 10 parts |

By the use of the heat transfer printing sheet thus obtained, the same heat transfer printing test as in Example IV-1 was carried out, thereby obtaining a sample of Example IV-4 having both a group of raised letters and that of inked letters.

With respect to the group of raised letters (the raised area) on this sample, the "height of the raised letters" and the "strength of the expanded images" were evaluated. As a result, the raised letters were found to have a height of 200 micrometers or more, and confirmed to be highly readable with the fingers. Further, regarding the "strength of the expanded images", it was confirmed that the thermally expanded dot elements were scarcely broken or separated from the image-receiving sheet when touched with the fingers and that the readability of the raised letters was not changed by repeated touch reading.

With respect to the group of inked letters (the inked area) on the sample, it was confirmed that the letters printed were extremely sharp. In other words, it was confirmed that the picture elements for forming the inked letters had been exactly transferred to the image-receiving sheet by the image-wise application of energy.

EXAMPLE V-1

A polyethylene terephthalate film having a thickness of 6.0 micrometers, whose one surface had been subjected to a heat-resistance-imparting treatment was used as a substrate sheet 1. A homogeneous coating liquid 1 for forming a thermally-expandable ink layer, having the following formulation was coated, by means of gravure reverse coating, onto the surface of the substrate sheet, opposite to the surface which had been made heat resistant, so that the thickness of the ink layer after dried would be 30 micrometers, and then dried, thereby obtaining a heat transfer printing sheet in a continuous film according to the present invention.

<Formulation of Coating Liquid 1 for Forming Thermally-Expandable Ink Layer>

| | |
|---|---|
| Aqueous dispersion of polyester ("Vylonal MD-1930" manufactured by Toyobo Co., Ltd., solids content: 30%, number-average molecular weight of the resin: 25,000) | 40 parts |
| Thermally-expandable micro-capsule ("MATSUMOTO MICRO SPHERE F-20VS" manufactured by Matsumoto Yushi-Seiyaku Company, Ltd., particle size: 3–8 micrometers) | 15 parts |
| Water | 20 parts |

The heat transfer printing sheet thus obtained was superposed on a sheet of high-grade paper having a thickness of 150 micrometers, serving as an image-receiving sheet, with the thermally-expandable ink layer 3 of the heat transfer printing sheet faced the surface of the paper. Heat was then applied to the back surface of the heat transfer printing sheet by using a thermal head (KMT-85-6MPD2-HTV), thereby conducting heat transfer printing. The printing conditions were as follows: the voltage applied to the thermal head was 12.0 V; the printing speed was 33.3 ms/line; and the pulse width of the voltage applied was 16 ms/line. In this step of printing, an image information was so controlled that picture elements of approximately 170 square micrometers, obtainable by the application of heat using the thermal head, would form a circle having a diameter of approximately 1 mm, whereby dot elements having a diameter of 1 mm with which raised letters would be formed were thermally transferred to the image-receiving sheet.

After the heat transfer printing sheet was released from the image-receiving sheet, infrared rays with a maximum-energy wavelength of 1.2 micrometers were applied to the image-receiving sheet for 10 seconds by an infrared heater (a short-wavelength-infrared radiator "ZKB 600/80G" manufactured by Heraeus Kabushiki Kaisha) which was placed at a distance of 5 cm. By this, the thermally-expandable ink layer 3 which had been transferred to the image-receiving sheet was expanded to produce raised letters. A sample of Example V-1 having the expanded dot elements was thus obtained.

EXAMPLE V-2

The procedure of Example V-1 was repeated except that the coating liquid 1 for forming a thermally-expandable ink layer used in Example V-1 was replaced by a coating liquid 2 for forming a thermally-expandable ink layer, having the following formulation, thereby obtaining a heat transfer printing sheet of the present invention. By the use of this heat transfer printing sheet, a sample of Example V-2 having dot elements which had been transferred and expanded in the same manner as in Example V-1 was obtained.

<Formulation of Coating Liquid 2 for Forming Thermally-Expandable Ink Layer>

| | |
|---|---|
| Polyester resin ("PLACCEL H1P" manufactured by Daicel Chemical Industries, Ltd., number-average molecular weight: 10,000) | 20 parts |
| Thermally-expandable micro-capsule ("MATSUMOTO MICRO SPHERE F-30VS" manufactured by Matsumoto Yushi-Seiyaku Company, Ltd., particle size: 10–20 micrometers) | 25 parts |
| Toluene | 200 parts |

EXAMPLE V-3

The procedure of Example V-1 was repeated except that the coating liquid 1 for forming a thermally-expandable ink layer used in Example V-1 was replaced by a coating liquid 3 for forming a thermally-expandable ink layer, having the following formulation, thereby obtaining a heat transfer printing sheet of the present invention. By the use of this heat transfer printing sheet, a sample of Example V-3 having dot elements which had been transferred and expanded in the same manner as in Example V-1 was obtained.

<Formulation of Coating Liquid 3 for Forming Thermally-Expandable Ink Layer>

| | |
|---|---|
| Aqueous dispersion of polyester ("Vylonal MD-1930" manufactured by Toyobo Co., Ltd., solids content: 30%, number-average molecular weight of the resin: 25,000) | 40 parts |
| Thermally-decomposable expanding agent (sodium hydrogen carbonate) | 15 parts |
| Water | 20 parts |

EXAMPLE V-4

To dot elements having a diameter of 1 mm, produced in the same manner as in Example V-1, infrared rays with a maximum-energy wavelength of 2.6 micrometers were applied for 15 seconds by using, instead of the infrared heater used in Example V-1, an infrared heater, "Type 650W" with a metallic reflective film (a medium-wavelength-infrared radiator manufactured by Heraeus Kabushiki Kaisha, the length of heating unit: 400 mm), which was placed at a distance of 5 cm, thereby expanding the dot elements (the thermally-expandable ink layer) which had been transferred to the image-receiving sheet. A sample of Example V-4 having the expanded dot elements was thus obtained.

EXAMPLE V-5

To dot elements having a diameter of 1 mm, produced in the same manner as in Example V-1, light was applied for 30 seconds by, instead of the infrared heater used in Example V-1, a bulb (100 V, 500 W, maximum-energy wavelength: 0.91 micrometers, color temperature: 3,200° K) of a halogen light for photo-lighting ("Mini-Focusing Light II (LQMF-II)" manufactured by RDS Co., Ltd.) which was placed at a distance of 5 cm, thereby expanding the dot elements (the thermally-expandable ink layer) which had been transferred to the image-receiving sheet. A sample of Example V-5 having the expanded dot elements was thus obtained.

COMPARATIVE EXAMPLE V-1

The image-receiving sheet on which dot elements having a diameter of 1 mm had been produced in the same manner as in Example V-1 was kept in contact with a hot plate whose temperature was adjusted to 90° C. for 10 seconds, thereby expanding, instead of using the infrared heater used in Example V-1, the thermally-expandable ink layer which had been transferred to the image-receiving sheet. A sample of Comparative Example V-1 having the expanded dot elements was thus obtained.

COMPARATIVE EXAMPLE V-2

The image-receiving sheet on which dot elements having a diameter of 1 mm had been produced in the same manner as in Example V-1 was kept in contact with a heating roller whose temperature was adjusted to 100° C. for 20 seconds, thereby expanding, instead of using the infrared heater used in Example V-1, the thermally-expandable ink layer which had been transferred to the image-receiving sheet. A sample of Comparative Example V-2 having the expanded dot elements was thus obtained.

[Evaluation Methods]

The resistance to touch reading of each of the above-obtained samples of Examples V-1 to V-4 and Comparative Examples V-1 and V-2, having the expanded dot elements was evaluated in accordance with the following standard.

◎: The expanded dot elements were never separated from the image-receiving sheet when touched with the fingers; the readability thereof was not changed at all by repeated touch reading.

○: The expanded dot elements were scarcely separated from the image-receiving sheet when touched with the fingers; the readability thereof was not greatly changed by repeated touch reading.

Δ: Some of the expanded dot elements were either separated from the image-receiving sheet or broken by repeated touch reading; the initial readability thereof was gradually impaired.

×: The expanded dot elements were readily separated from the image-receiving sheet when touched with the fingers; it was difficult to know the existence of the dot elements with the fingers.

Further, the height of the expanded images was measured by a micrometer, and evaluated in accordance with the following standard.

◎: The height was 250 micrometers or more; the raised letters were highly readable with the fingers.

○: The height was in the range of 100 to 250 micrometers; it was possible to know with the fingers the existence of the dot elements, but difficult to recognize individual dots arranged in a raised letter consisting of 6 dot elements, so that it was difficult to read the raised letters with the fingers.

×: The height was less than 100 micrometers; it was possible to know with the fingers the existence of the raised images on the image-receiving sheet, but difficult to recognize them as dot elements.

Furthermore, the percentage of void in the expanded image was calculated from the previously-mentioned equation (1).

The results were as shown in the following Table v.

TABLE V

| | Height of Expanded Images | Resistance to Touch Reading | Percentage of Void (%) |
|---|---|---|---|
| Example V-1 | ◎ | ○ | 98 |
| Example V-2 | ◎ | ○ | 98 |
| Example V-3 | ○ | Δ | 93 |
| Example V-4 | ○ | ○ | 95 |
| Example V-5 | ○ | ◎ | 92 |
| Comp. Ex. V-1 | x | x | 85 |
| Comp. Ex. V-2 | x | x | 82 |

EXAMPLE VI-1

A polyethylene terephthalate film having a thickness of 6.0 micrometers, whose one surface had been subjected to a heat-resistance-imparting treatment was used as a substrate sheet 1. A homogeneous coating liquid 1 for forming a thermally-expandable ink layer, having the following formulation was coated, by means of gravure reverse coating, onto the surface of the substrate sheet, opposite to the surface which had been made heat resistant, so that the thickness of the ink layer after dried would be 30 micrometers. The resulting layer was then dried by blowing air of 50° C. for 30 seconds. Thus, a heat transfer printing sheet in a continuous film according to the present invention was obtained.

<Formulation of Coating Liquid 1 for Forming Thermally-Expandable Ink Layer>

| | |
|---|---|
| Aqueous dispersion of polyester ("Vylonal MD-1930" manufactured by Toyobo Co., Ltd., solids content: 30%, number-average molecular weight of the resin: 25,000) | 40 parts |
| Thermally-expandable micro-capsule ("MATSUMOTO MICRO SPHERE F-20VS" manufactured by Matsumoto Yushi-Seiyaku Company, Ltd.) | 15 parts |
| Water | 20 parts |

The thermally-expandable ink layer of this heat transfer printing sheet was observed by a scanning electron microscope with an accelerating voltage of 10 kV and a magnifying power of 5,000. As a result, numerous cracks having a width of 0.1 to 1.2 micrometers were found on the surface of the thermally-expandable ink layer. Further, it was also confirmed that the depth of the cracks was approximately 5 micrometers and that the rate of the surface area of the cracks to that of the thermally-expandable ink layer was approximately 5%.

The heat transfer printing sheet was superposed on a sheet of high-grade paper having a thickness of 150 micrometers, serving as an image-receiving sheet, with the thermally-expandable ink layer of the heat transfer printing sheet faced the surface of the paper. Heat was then applied to the back surface of the heat transfer printing sheet by using a thermal head ("KMT-85-6MPD2-HTV"), thereby conducting heat transfer printing. The printing conditions were as follows: the voltage applied to the thermal head was 12.0 V; the printing speed was 33.3 ms/line; and the pulse width of the voltage applied was 16.0 ms/line. In this step of printing, an image information was so controlled that picture elements of approximately 170 square micrometers, obtainable by the application of heat using the thermal head, would form a circle having a diameter of approximately 1 mm, whereby dot elements having a diameter of 1 mm with which raised letters would be produced were thermally transferred to the image-receiving sheet.

Thereafter, the heat transfer printing sheet was released from the image-receiving sheet, and the image-receiving sheet was heated in an oven at 100° C. for one minute to expand the thermally-expandable ink layer which had been transferred thereto. A sample of Example VI-1 having the expanded dot elements was thus obtained.

EXAMPLE VI-2

The procedure of Example VI-1 was repeated except that the thermally-expandable ink layer formed by coating the coating liquid 1 was dried by blowing air of 40° C. for 50 seconds, instead of blowing air of 50° C. for 30 seconds, thereby obtaining a heat transfer printing sheet in a continuous film according to the present invention. The thermally-expandable ink layer of this heat transfer printing sheet was observed by a scanning electron microscope in the same manner as in Example VI-1. As a result, numerous cracks having a width of 0.05 to 0.5 micrometers were found on the surface of the thermally-expandable ink layer. Further, it was also confirmed that the depth of the cracks was approximately 3 micrometers and that the rate of the surface area of the cracks to that of the thermally-expandable ink layer was approximately 0.8%.

By the use of this heat transfer printing sheet, a sample of Example VI-2 having expanded dot elements was obtained in the same transfer printing and expanding manners as in the above Example VI-1.

EXAMPLE VI-3

The procedure of Example VI-1 was repeated except that the thermally-expandable ink layer formed by coating the coating liquid 1 was dried by blowing air of 70° C. for 30 seconds, instead of blowing air of 50° C. for 30 seconds, thereby obtaining a heat transfer printing sheet in a continuous film according to the present invention. The thermally-expandable ink layer of this heat transfer printing sheet was observed by a scanning electron microscope in the same manner as in Example VI-1. As a result, numerous cracks having a width of 0.5 to 2.0 micrometers were found on the surface of the thermally-expandable ink layer. Further, it was also confirmed that the depth of the cracks was approximately 5 micrometers and that the rate of the surface area of the cracks to that of the thermally-expandable ink layer was approximately 18%.

By the use of this heat transfer printing sheet, a sample of Example VI-3 having expanded dot elements was obtained in the same transfer printing and expanding manners as in Example VI-1.

EXAMPLE VI-4

The procedure of Example VI-1 was repeated except that the coating liquid 1 for forming a thermally-expandable ink layer used in Example VI-1 was replaced by a coating liquid 2 for forming a thermally-expandable ink layer, having the following formulation, thereby obtaining a heat transfer printing sheet in a continuous film according to the present invention. The thermally-expandable ink layer of this heat transfer printing sheet was observed by a scanning electron microscope in the same manner as in Example VI-1. As a result, numerous cracks having a width of 0.1 to 1.2 micrometers were found on the surface of the thermally-expandable ink layer. Further, it was also confirmed that the depth of the cracks was approximately 5 micrometers and that the rate of the surface area of the cracks to that of the thermally-expandable ink layer was approximately 5%.

By the use of this heat transfer printing sheet, a sample of Example VI-4 having expanded dot elements was obtained in the same transfer printing and expanding manners as in Example VI-1.

<Formulation of Coating Liquid 2 for Forming Thermally-Expandable Ink Layer>

| | |
|---|---|
| Aqueous dispersion of polyester ("Vylonal MD-1930" manufactured by Toyobo Co., Ltd., solids content: 30%, number-average molecular weight of the resin: 25,000) | 40 parts |
| Thermally-decomposable expanding agent (sodium hydrogen carbonate) | 15 parts |
| Water | 20 parts |

EXAMPLE VI-5

A thermally-expandable ink layer was formed on the substrate sheet in the same manner as in Example VI-1 (the state of the cracks formed on the surface of the ink layer was also the same as that of the cracks formed in Example VI-1). A coating liquid for forming a heat-sensitive adhesive layer, having the following formulation was coated, by means of roll coating, onto the thermally-expandable ink layer so that the thickness of the adhesive layer after dried would be 2 micrometers. The resulting layer was then dried by blowing air of 50° C. for 30 seconds to form a heat-sensitive adhesive layer. Thus, a heat transfer printing sheet in a continuous film according to the present invention was obtained. The heat-sensitive adhesive layer of this heat transfer printing sheet was observed by a scanning electron microscope in the same manner as in Example VI-1. As a result, numerous cracks having a width of 0.1 to 1.2 micrometers were found on the surface of the heat-sensitive adhesive layer. Further, it was also confirmed that the depth of the cracks was approximately 3 micrometers and that the rate of the surface area of the cracks to that of the heat-sensitive adhesive layer was approximately 3%. It is noted that the cracks formed on the thermally-expandable ink layer and those formed on the heat-sensitive adhesive layer were discontinuous in the direction of thickness of the layers.

By the use of this heat transfer printing sheet, a sample of Example VI-5 having expanded dot elements was obtained in the same transfer printing and expanding manners as in Example VI-1.

<Formulation of Coating Liquid for Forming Heat-Sensitive Adhesive Layer>

| | |
|---|---|
| Aqueous dispersion of polyester ("Vylonal MD-1930" manufactured by Toyobo Co., Ltd., solids content: 30%, number-average molecular weight of the resin: 25,000) | 20 parts |
| Water | 10 parts |

COMPARATIVE EXAMPLE VI-1

The procedure of Example VI-1 was repeated except that the thermally-expandable ink layer formed by coating the coating liquid 1 was dried by blowing air of 120° C. for 30 seconds, instead of blowing air of 50° C. for 30 seconds, thereby obtaining a comparative heat transfer printing sheet in a continuous film. The thermally-expandable ink layer of this heat transfer printing sheet was observed by a scanning electron microscope in the same manner as in Example VI-1. As a result, no cracks were found at all on the surface of the thermally-expandable ink layer. By the use of this heat transfer printing sheet, a sample of Comparative Example VI-1 having expanded dot elements was obtained in the same transfer printing and expanding manners as in Example VI-1.

[Evaluation]

In terms of the separability of the thermally-expandable ink layer, the above-obtained samples of Examples VI-1 to VI-5 and Comparative Example VI-1 were evaluated in the following manner.

The heat transfer printing sheet was released from the image-receiving sheet after heat was applied by the thermal head. At this time, the degree of unfavorable transfer of a non-heated part, surrounding the heated part, of the thermally-expandable ink layer to the image-receiving sheet together with the heated part, caused because the heated part is not clearly separated from the non-heated part, was evaluated in accordance with the following standard:

◎: The heated part of the thermally-expandable ink layer was perfectly separated from the non-heated part, and transferred to the image-receiving sheet; the resulting raised letters were highly readable with the fingers. Only an extremely weak force was needed to release the heat transfer printing sheet from the image-receiving sheet; it was very easy to release the heat transfer printing sheet from the image-receiving sheet.

○: The heated part of the thermally-expandable ink layer was almost perfectly separated from the non-heated part, and transferred to the image-receiving sheet; the raised letters obtained were readable with the fingers. Only a relatively weak force was needed to release the heat transfer printing sheet from the image-receiving sheet; it was easy to release the heat transfer printing sheet from the image-receiving sheet.

×: The heated part of the thermally-expandable ink layer was not clearly separated from the non-heated part, so that clear-cut dot elements could not be obtained; it was difficult to read the resulting raised letters with the fingers. A strong force was needed to release the heat transfer printing sheet from the image-receiving sheet; it was not easy to release the heat transfer printing sheet from the image-receiving sheet.

The results of the above evaluation were as shown in Table VI. Although it is not shown in Table VI, the samples of the present invention were found to be extremely excellent in the height of raised letters and the strength of expanded images.

TABLE VI

| | Separability of thermally-expandable ink layer |
|---|---|
| Example VI-1 | ◎ |
| Example VI-2 | ○ |
| Example VI-3 | ◎ |
| Example VI-4 | ◎ |
| Example VI-5 | ○ |
| Comparative Example VI-1 | x |

What is claimed is:

1. A process for producing raised images, comprising the steps of:

superposing, on an image-receiving sheet, a heat transfer printing sheet comprising a substrate sheet and a thermally-expandable ink layer formed thereon, heating image-wise the thermally-expandable ink layer and bringing the heat transfer printing sheet into pressure contact with the image-receiving sheet, releasing the heat transfer printing sheet from the image-receiving sheet, thereby separating image-wise the thermally-expandable ink layer from the heat transfer printing sheet, and transferring it to the image-receiving sheet, applying light to the thermally-expandable ink layer which has been transferred image-wise to the image-receiving sheet to expand it, thereby obtaining raised images.

2. The process according to claim 1, wherein the light to be applied to the thermally-expandable ink layer which has been transferred image-wise to the image-receiving sheet has a maximum-energy wavelength of 0.8 to 100 micrometers.

3. The process according to claim 2, wherein the light has a maximum-energy wavelength of 1.0 to 4.0 micrometers.

* * * * *